United States Patent [19]

Yoneyama et al.

[11] Patent Number: 5,004,675

[45] Date of Patent: Apr. 2, 1991

[54] METHOD FOR PROCESSING A SILVER HALIDE PHOTOSENSITIVE MATERIAL FOR COLOR PHOTOGRAPHY

[75] Inventors: Hiroyuki Yoneyama; Osamu Takahashi; Kazuaki Yoshida; Takatoshi Ishikawa, all of Kanagawa, Japan

[73] Assignee: Fuji Photo Film Co., Ltd., Kanagawa, Japan

[21] Appl. No.: 416,797

[22] Filed: Oct. 3, 1989

[30] Foreign Application Priority Data

Oct. 3, 1988 [JP] Japan ..... 63-249238

[51] Int. Cl.[5] ..... G03C 7/46; G03C 7/407

[52] U.S. Cl. ..... 430/377; 430/372; 430/376; 430/380; 430/382; 430/383; 430/467; 430/545; 430/546; 430/551; 430/963

[58] Field of Search ..... 430/376, 380, 382, 383, 430/467, 963, 545, 546, 377, 551, 372

[56] References Cited

U.S. PATENT DOCUMENTS

| | | | |
|---|---|---|---|
| 3,044,873 | 7/1962 | Haas | 96/29 |
| 3,619,195 | 11/1971 | Van Campen | 96/100 |
| 4,798,783 | 1/1989 | Ishikawa et al. | 430/372 |
| 4,853,321 | 8/1989 | Momoki et al. | 430/380 |
| 4,880,728 | 11/1989 | Ishikawa et al. | 430/380 |

FOREIGN PATENT DOCUMENTS

| | | |
|---|---|---|
| 0256537 | 2/1988 | European Pat. Off. . |
| 0526531 | 2/1988 | European Pat. Off. . |
| 63-014147 | 1/1988 | Japan . |

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A method for processing a silver halide color photosensitive material is disclosed.

The process step comprises developing a color photographic light-sensitive material composed of a support having thereon at least one light-sensitive silver halide emulsion layer containing a silver halide containing at least 80 mol % silver chloride; at least one emulsion layer thereof containing a dispersion of a mixture of (i) at least one oil-soluble non-diffusible cyan coupler capable of forming a substantially non-diffusible cyan dye by coupling with the oxidized form of a developing agent, and (ii) a water-insoluble polymer;

in a color developer solution comprising a primary amine color developing agent, and having a chloride ion concentration of from $3.5\times10^{-2}$ to $1.5\times10^{-1}$ mol/l, and a bromide ion concentration of from $3.0\times10^{-5}$ to $1.0\times10^{-3}$ mol/l.

When used in rapid processing methods, the method according to the invention prevents pressure-sensitization fogging, and provides high maximum density and low minimum density images.

25 Claims, No Drawings

METHOD FOR PROCESSING A SILVER HALIDE PHOTOSENSITIVE MATERIAL FOR COLOR PHOTOGRAPHY

FIELD OF THE INVENTION

The present invention relates to a method for processing a silver halide photosensitive material for color photography and more particularly to a method for rapid development of a high-silver-chloride (high-chloride) silver halide photosensitive material.

BACKGROUND OF THE INVENTION

In the photographic processing of photosensitive materials for color photography, the recent demand for quick print delivery and reduced commercial laboratory work load has made it necessary to reduce the photographic processing time. While the commonest approach to a shortening of processing time is to increase the processing temperature and/or the replenishment rate, many other procedures such as intensified agitation and addition of accelerators have been proposed.

Particularly, for rapid color development and/or reducing the replenishment rate, the use of a color photosensitive material employing a silver chloride emulsion instead of conventional silver bromide and silver iodide emulsions has been proposed. For example, PCT WO-04534/1987 discloses a rapid processing technique in which a chloride-rich silver halide color photosensitive material is treated with a color developer which is substantially free from sulfite ions and benzyl alcohol.

However, the above-mentioned method is disadvantageous, since when it is used in an automatic developing apparatus for paper, fog streaks readily appear. These are presumably in-liquid pressure sensitization due to pressure applied to the silver halide emulsion by contact of a photosensitive material with a roller or the like in the developing tank of the automatic developing apparatus.

Furthermore, in continuous processing, this method allows remarkable variations in photographic characteristics (in particular minimum density) and marked staining of the white background.

The rapid processing of a high-silver-chloride photosensitive material for color photography presents problems such as in-liquid pressure sensitization fogging and variation of photographic characteristics, and is unsuitable for practical use.

JP-A-58-95345 and 59-232342 (the term "JP-A" herein used means an unexamined published Japanese patent application) describe the use of organic antifogging agents for the purpose of minimizing the variations in photographic characteristics (in particular, fogging) in rapid processing using a high-silver-chloride photosensitive material for color photography. However, their antifogging effect is unsatisfactory and, in general, they fail to prevent the above-mentioned sensitization streaks due to pressure in the liquid phase or an increase in minimum density during continuous processing. Furthermore, their effect decreases with the progress of continuous processing.

JP-A-61-70552 describes a method for reducing the rate of developer replenishment by using a high-chloride silver halide photosensitive material for color photography and adding the replenisher to the developing bath during development at a rate such that no overflowing may occur. JP-A-63-106655 discloses a method of processing a silver halide photosensitive material for color photography whose silver halide emulsion layer has a high silver chloride content, with a color developer containing a hydroxylamine compound and a chloride at a minimum concentration for the purpose of process stabilization.

JP-A-63-106655 describes a method of processing a photosensitive material having a silver chloride proportion of 70 mole percent or more with a developer containing a chloride in a concentration of at least $2\times10^{-2}$ moles.

However, these methods also are unsuited for practical use, since they pressure sensitization streaks are formed upon processing in an automatic developing apparatus or the photographic characteristics vary during continuous processing.

SUMMARY OF THE INVENTION

Accordingly, it is a first object of the invention to provide a method of rapid processing of a high-silver-chloride photosensitive material for color photography without various types of pressure sensitization fogging.

It is a second object of the invention to provide a method of processing a high-silver-chloride photosensitive material for color photography which provides a high maximum density and a low minimum density as well as markedly reduced variations in photographic characteristics (in particular, minimum density).

It has now been found that these and other objects of the present invention are attained by a method for processing a silver halide color photosensitive material which comprises developing a color photographic light-sensitive material comprising a support having thereon at least one light-sensitive silver halide emulsion layer containing a silver halide comprising at least 80 mol % silver chloride; at least one emulsion layer thereof comprising a dispersion of a mixture of (i) at least one oil-soluble non-diffusible cyan coupler capable of forming a substantially non-diffusible cyan dye by coupling with the oxidized form of a developing agent, and (ii) a water-insoluble polymer;

in a color developer solution comprising a primary amine color developing agent, and having a chloride ion concentration of from $3.5\times10^{-2}$ to $1.5\times10^{-1}$ mol/l, and a bromide ion concentration of from $3.0\times10^{-5}$ to $1.0\times10^{-3}$ mol/l.

DETAILED DESCRIPTION OF THE INVENTION

Although the chloride ion is well known as an antifogging agent, its effect is limited. Even when used in large amounts, it cannot completely prevent increasing fogging in a continuous processing apparatus or the formation of fog streaks in processing in an automatic developing apparatus, but may produce adverse effects, by retarding the development and/or reducing the maximum density.

The bromide ion is also known as an antifogging agent. However, when used alone, it suppresses the development process and reduces the maximum density and sensitivity, and therefore is not suited for practical use although when used in adequate amounts, it can prevent fogging in continuous processing as well as pressure fogging streaks.

As a result of intensive investigations, the present inventors have found that the formation of pressure fogging streaks during processing in an automatic developing apparatus and the variations in photographic characteristics (especially, minimum density) in continuous processing can be prevented without any substantial decrease in maximum density when a photosensitive material in which the silver chloride content is not less than 80 mole percent and which contains at least one cyan coupler dispersed by means of a hydrophobic polymer is treated with a color developer containing $3.5\times10^{-2}$ to $1.5\times10^{-1}$ moles/liter of chloride ion and $3.0\times10^{-5}$ to $1.0\times10^{-3}$ mole/liter of bromide ion.

When the chloride ion and bromide ion are used alone, such effects are never produced, and it is unexpected and surprising that such effects are obtained when they are used in combination, in accordance with the invention in the respective concentration ranges specified above.

The detailed mechanisms resulting in these surprising benefits remain unknown, but without being limited in any way by theory, are considered to be as follows.

The pressure fogging streaks appearing upon processing on an automatic developing apparatus are presumably due to excessive pressure applied to the exposed photosensitive material in the color developer and formation of fog nuclei or centers as a result of intensification in the pressurized portions. It is considered that the physical strength of the coating layer is improved by dispersing cyan couplers with the polymer specified above, so that the external force applied to the coat layer can be dispersed efficiently and, consequently, the fog center formation can be inhibited.

It is further considered that the bromide and chloride ions contained in the developer in adequate amounts in accordance with the invention selectively prevent the fog centers from being developed and thereby inhibit fogging without retarding the development or reducing the maximum density or sensitivity. Such a selective development-inhibiting effect resulting from the combination of the bromide and chloride ions in the respective specific concentration ranges cannot be fully explained in terms of a change in reduction potential of silver ion in the presence of halogens alone. It is considered likely that the state of adsorption of bromide and chloride ions on silver halide grains is of great influence.

The effect of inhibiting variations in photographic characteristics in continuous processing cannot be exclusively due to high developing activity resulting from the use of a high-chloride silver emulsion and to balanced activity reduction due to the presence of the bromide and chloride ions in adequate amounts, i.e., to high activity-high restraint type development.

In accordance with the invention, the silver halide emulsion is substantially composed of silver chloride. The term "substantially" as used herein means that the silver chloride content is not less than 80 mole percent, preferably not less than 95 mole percent, more preferably not less than 98 mole percent, based on the whole silver halide content. For rapid processing, a higher silver chloride content is preferred.

In accordance with the invention, the color developer contains $3.5\times10^{-2}$ to $1.5\times10^{-1}$ moles/liter, preferably $4\times10^{-2}$ to $1\times10^{-1}$ mole/liter, of chloride ions. Chloride ion concentrations exceeding $1.5\times10^{-1}$ moles/liter are disadvantageous in that the development is retarded, preventing rapid development and high maximum density. At chloride ion concentrations below $3.5\times10^{-2}$ moles/liter, the formation of pressure fogging streaks cannot be prevented and the variations in photographic characteristics (especially, minimum density) in continuous processing are great.

In accordance with the invention, the color developer contain $3.0\times10^{-5}$ to $1.0\times10^{-3}$ mole/liter, preferably $5.0\times10^{-5}$ to $5\times10^{-4}$ moles/liter, of bromide ion. Bromide ion concentrations exceeding $1\times10^{-3}$ mole/liter retard the development and reduce the maximum density and sensitivity. At levels below $3.0\times10^{-5}$ moles/liter, the formation of pressure fogging streaks cannot be inhibited and variations in photographic characteristics (in particular, minimum density) occur in continuous processing.

The chloride ion and bromide ion may be added directly to the developer or may be released from the photosensitive material in the developer.

The chloride ion source for direct addition to the color developer, includes sodium chloride, potassium chloride, ammonium chloride, lithium chloride, nickel chloride, magnesium chloride, manganese chloride, calcium chloride and cadmium chloride. Preferred among them are sodium chloride and potassium chloride.

Either ion may further be supplied from a fluorescent or optical brightener added to the developer. The bromide ion source include sodium bromide, potassium bromide, ammonium bromide, lithium bromide, calcium bromide, magnesium bromide, manganese bromide, nickel bromide, cadmium bromide, cerium bromide, and thallium bromide. Among these, potassium bromide and sodium bromide are preferred.

Where they are released from the photosensitive material in the developer into the developer solution, the chloride ion and bromide ion both may be supplied from the emulsion layer or some other layer.

In the present invention, the color developer is preferably substantially free from sulfite ions from the viewpoints of stabilized continuous processing and streaky pressure fog prevention. For inhibiting or preventing developer degradation, it is also possible to refrain from using the developer for a prolonged period of time; to use a physical means, such as a floating lid or a reduced bath opening ratio, for minimizing the influence of air oxidation; or to use a chemical means, for example, to lower the developer temperature or add an organic preservative. For simplicity, the use of an organic preservative is advantageous.

The term "organic preservative" as used herein means any and all organic compounds which, when added to a processing solution for color photographic light-sensitive materials, would reduce the rate of degradation of the aromatic primary amine color developing agent. Thus, an organic preservative is an organic compound which inhibits atmospheric or other oxidation of color developing agents. Particularly useful organic preservatives are hydroxylamine derivatives (exclusive of hydroxylamine, here and below), hydroxamic acid compounds, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines. These compounds are disclosed in JP-A-63-4235, JP-A-63-30845, JP-A-6321647, JP-A-63-44655, JP-A-63-53551, JP-A-63-43140, JP-A-63-56654, JP-A-63-58346, JP-A-63-43138, JP-A-63-146041, JP-A-63-170642, JP-A-63-44657 and JP-A-63-44656, U.S. Pat. Nos. 3,613,503 and 2,494,903, JP-A-52-143020, JP-B-48-30496 (the term JP-B having used means an "unexamined Japanese patent publication") and so on.

The following preferred organic preservatives are illustrated by structural formulas and specific examples, but the present invention is not to be construed as being limited thereto.

The compounds described below are added to color developers in an amount of 0.005 mole/liter to 0.5 mole/liter, preferably 0.03 mole/liter to 0.1 mole/liter.

In particular, the addition of hydroxylamine derivatives and/or hydrazine derivatives is preferred.

Preferred hydroxylamine derivatives are compounds of formula (I):

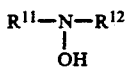

(I)

wherein $R^{11}$ and $R^{12}$, which may be the same or different, each represents hydrogen, an unsubstituted or substituted $C_{1-10}$, preferably $C_{1-5}$ alkyl group, an unsubstituted or substituted $C_{2-10}$ alkenyl group, an unsubstituted or substituted $C_{6-10}$ aryl group or a substituted or unsubstituted heteroaromatic group, provided that when $R^{11}$ is hydrogen, $R^{12}$ is a group other than hydrogen; $R^{11}$ and $R^{12}$ may be linked to form, together with the nitrogen atom, a saturated or unsaturated five- or six-membered heterocycle containing a carbon, hydrogen atom, a halogen atom, oxygen, nitrogen, or sulfur.

It is preferred that $R^{11}$ and $R^{12}$ each represents an alkyl or alkenyl group. The number of carbon atoms in each group is preferably up to 10, in particular up to 5. The nitrogen-containing heterocycle formed by $R^{11}$ and $R^{12}$ together with the adjacent nitrogen atom includes piperidyl, pyrrolidyl, N-alkylpiperazinyl, morpholyl, indolinyl and benzotriazole.

Preferred substituents for $R^{11}$ and $R^{12}$ include hydroxyl, alkoxy, alkylsulfonyl, arylsulfonyl, amido, carboxyl, cyano, sulfo, nitro and amino groups. Specific examples of compounds represented by formula (I) are as follows, but the present invention is not to be construed as being limited thereto.

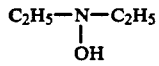

I-1

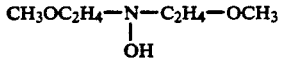

I-2

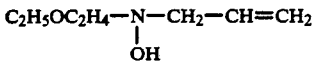

I-3

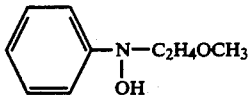

I-4

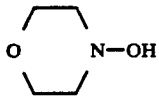

I-5

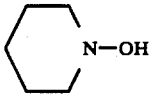

I-6

-continued

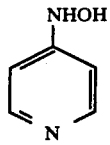

I-7

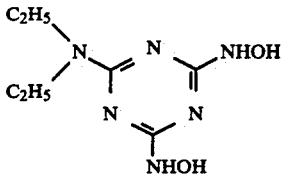

I-8

The following are preferred hydrazine and hydrazide organic preservatives:

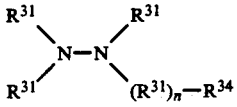

(II)

wherein $R^{31}$, $R^{32}$ and $R^{33}$, which may be the same or different, each represents hydrogen or a substituted or unsubstituted $C_{1-10}$ alkyl, $C_{6-10}$ aryl or heterocyclic group; $R^{34}$ represents a hydroxyl group, a hydroxyamino group or a substituted or unsubstituted $C_{1-10}$ alkyl, $C_{6-10}$ aryl, $C_{1-10}$ heterocyclic, $C_{1-10}$ alkoxy, $C_{6-10}$ aryloxy, carbamoyl or amino group. The heterocyclic group is a five- or six-membered, saturated or unsaturated group and may contain C, H, 0, N, S and halogen atoms. $X^{31}$ is a divalent linking group selected from —CO—, —$SO_2$— and —C(=NH)—, and n is 0 or 1. In particular, when n is 0, $R^{34}$ is an alkyl, aryl or heterocyclic group; and $R^{33}$ and $R^{34}$ may be linked to form a heterocycle together with the adjacent nitrogen atom.

Those compounds represented by formula (II), in which $R^{31}$, $R^{32}$ and $R^{33}$ each is hydrogen or a $C_1$-$C_5$ alkyl group are preferred. Particularly preferred are those in which $R^{31}$ and $R^{32}$ each is hydrogen.

Preferred as the group $R^{34}$ in formula (II) are alkyl, aryl, alkoxy, carbamoyl and amino groups. An alkyl or substituted alkyl group is particularly preferred. The subsituted alkyl group that is preferred be substituted with at least one carboxyl, sulfo, nitro, amino, or phosphono group. $X^{31}$ is preferably —CO—, or —$SO_2$—, and more preferably —CO—.

Specific compounds represented by formula (II) are described below, but the present invention is not to be construed as being limited thereto:

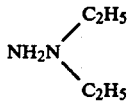

II-1

$NH_2NH(CH_2)_4SO_3H$ II-2

$NH_2NH(CH_2)_2OH$ II-3

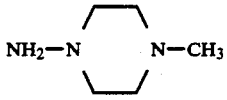

II-4

-continued

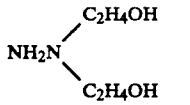

II-5

$NH_2NHCOCH_3$ II-6

$NH_2NHCOOC_2H_5$ II-7

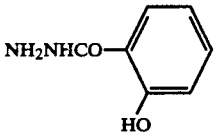

II-8

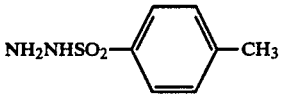

II-9

$NH_2NHCONH_2$ II-10

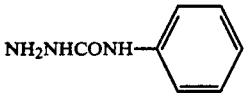

II-11

$NH_2NHSO_3H$ II-12

$NH_2NHC(=NH)NH_2$ II-13

$NH_2NHCOCONHNH_2$ II-14

$NH_2NHCH_2CH_2CH_2SO_3H$ II-15

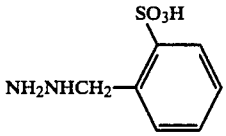

II-16

$NH_2NHCH(C_4H_9(n))COOH$ II-17

$NH_2NHCH_2CH_2COOH$ II-18

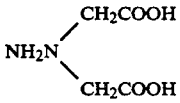

II-19

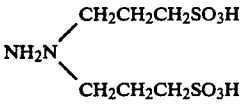

II-20

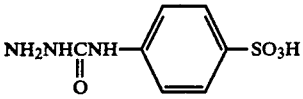

II-21

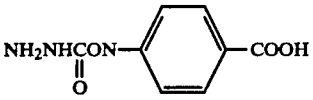

II-22

The combined use of a compound of the above formula (I) or (II) and an amine of formula (III) or (IV) given below is preferred to improve color developer stability and continuous processing process stability. Formula (III):

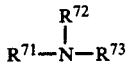

In the above formula, $R^{71}$, $R^{72}$ and $R^{73}$, which may be the same or different each is hydrogen or an alkyl, alkenyl, aryl, aralkyl or heterocyclic group having 1 to 10 carbon atoms. $R^{71}$ and $R^{72}$, $R^{71}$ and $R^{73}$, or $R^{72}$ and $R^{73}$ may be linked to form, together with the adjacent nitrogen atom, a nitrogen-containing heterocyclic group.

The groups $R^{71}$, $R^{72}$ and $R^{73}$ may optionally be substituted. Hydrogen or an alkyl group is particularly preferred as each of $R^{71}$, $R^{72}$ and $R^{73}$. The substituents include hydroxyl, sulfo, carboxyl, halogen, nitro, and amino groups. Specific examples of compounds of formula (III) are as follows, but the present invention is not to be construed as being limited thereto:

$N(CH_2CH_2OH)_3$ III-1

$H_2NCH_2CH_2OH$ III-2

$HN(CH_2CH_2OH)_2$ III-3

$C_7H_{15}N(CH_2CH(OH)CH_2OH)_2$ III-4

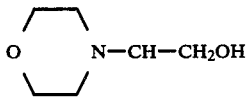

III-5

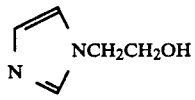

III-6

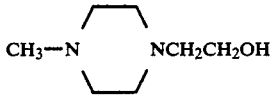

III-7

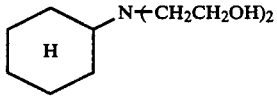

III-8

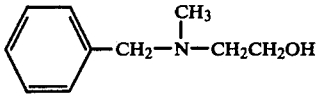

III-9

$(HOCH_2CH_2)_2NCH_2CH_2SO_2CH_3$ III-10

$HN(CH_2COOH)_2$ III-11

$HOOCCH_2CH_2CH(NH_2)COOH$ III-12

$H_2NCH_2CH_2SO_2HN_2$ III-13

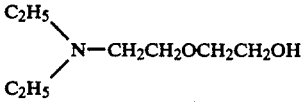

III-14

$H_2N-C(CH_2OH)_2$ III-15

$HOCH_2CH(NH_2)COOH$ III-16

-continued

III-17

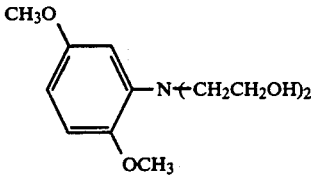

III-18

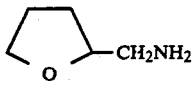

III-19

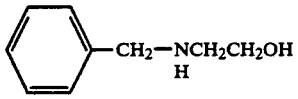

III-20

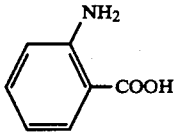

Formula (IV):

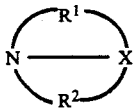

In the above formula, X is a trivalent atom or atomic group required for completing the condensed ring system and $R^1$ and $R^2$ each is an alkylene, arylene, alkenylene or aralkylene group.

The groups $R^1$ and $R^2$ may be the same or different.

Particularly preferred compounds of formula (IV) are those represented by formula (IV) are those represented by formula (IV-a) or (IV-b):

(IV-a)

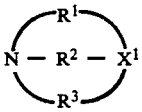

In the above formula, $X^1$ is

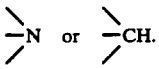

$R^1$ and $R^2$ are as defined in Formula (IV) and $R^3$ is has the same definition as $R^1$ or $R^2$, or is —$CH_2CO$—.

In formula (IV-a), $X^1$ is preferably

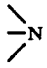

and $R^1$, $R^2$ and $R^3$ each preferably contains not more than 6 carbon atoms, more preferably not more than 3 carbon atoms and most preferably 2 carbon atoms.

$R^1$, $R^2$ and $R^3$ each preferably is an alkylene or arylene group and more preferably an alkylene group.

(IV-b)

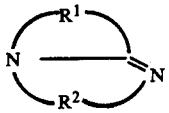

In the above formula, $R^1$ and $R^2$ each is defined in formula (IV).

In formula (IV-b), $R^1$ and $R^2$ each preferably contains not more than 6 carbon atoms. $R^1$ and $R^2$ each preferably is an alkylene or arylene group and more preferably an alkylene group.

Among the compounds of general formula (IV-a) and (IV-b), those of general formula (IV-a) are particularly preferred.

Specific examples of compounds represented by formula (IV) are as follows, but the present invention is not to be construed as being limited thereto.

IV-1

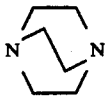

IV-2

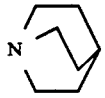

IV-3

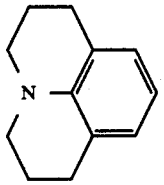

IV-4

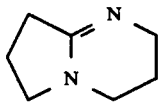

IV-5

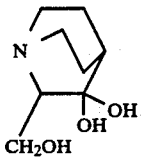

IV-6

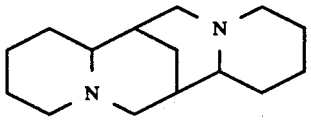

IV-7

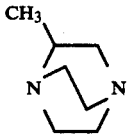

IV-8

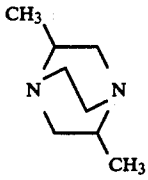

-continued

IV-9

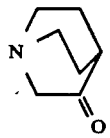

IV-10

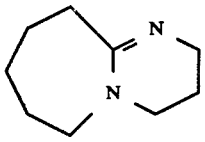

IV-11

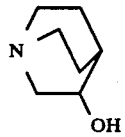

IV-12

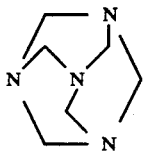

IV-13

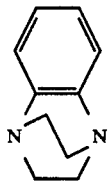

IV-14

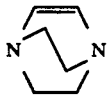

IV-15

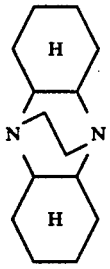

IV-16

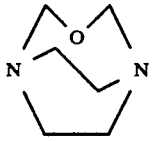

IV-17

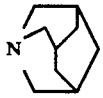

-continued

IV-18

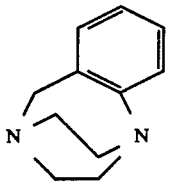

The combined use of at least one of the above-mentioned organic preservatives of general formula (I) or (III) and at least one of the preservatives of general formula (III) or (IV) is preferred.

The above-described organic preservatives are either commercially available on the market or synthesizable by the methods described in Japanese Patent Application No. 124038/1987 and No. 24374/1987, for instance.

The color developer used in accordance with the present invention contains a conventional aromatic primary amine color developing agent. p-Phenylenediamines are preferred and the following specific examples are suitable, but the present invention is not to be construed as being limited thereto:

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl)amino]-aniline

D-4: 4-Amino-3-methyl-N-ethyl-N-(β-methanesulfonamidoethyl)aniline

These p-phenylenediamine derivatives may be used as the corresponding sulfates, hydrochlorides, p-toluenesulfonates and other salts. The amount of aromatic primary amine developing agent is preferably about 0.1 to 20 g and more preferably about 0.5 to 10 g per liter of the developer.

The pH of the color developer to be used in accordance with the present invention is preferably 9 to 12 and more preferably 9 to 11.0, and this color developer may further contain other known developing agents.

The above-mentioned pH is preferably established with buffers. Among the buffers useful for this purpose are sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of the above buffer or buffers added to the color developer is preferably not less than 0.1 mole/l and more preferably in the range of 0.1 to 0.4 mole/l.

In addition, the color developer may contain various chelating compounds for preventing precipitation of calcium and magnesium or improving the stability of the solution. The following specific examples are not to be construed as limiting the present invention.

Nitrilotriacetic acid, diethylenetriaminepentaacetic acid, ethylenediaminetetraacetic acid, triethylenetetraminehxaacetic acid, N,N,N-trimethylenesulfonic acid, ethylenediamine-N,N,N',N'-tetramethylenesulfonic acid, 1,3-diamino-2-propanoltetraacetic acid, trans-cyclohexanediaminetetraacetic acid, nitrilotripropionic acid, 1,2diaminopropanetetraacetic acid, hydroxyethyliminodiacetic acid, glycol etherdiaminetetraacetic acid, hydroxyethylenediaminetriacetic acid, ethylenediamine-o-hydroxyphenylacetic acid, 2-phosphonobutane-1,2,4-tricarboxylic acid, N,N'-bis(2 hydroxybenzyl)ethylenediamine-N,N'-diacetic acid, catechol 3,4,6-trisulfonic acid, catechol-3,5disulfonic acid, 5-sulfosalicyclic acid, and 4-sulfosalicyclic acid.

These chelating agents may be used in combination as necessary.

The amount of chelating agent or agents should only be sufficient to block the metallic ions in the color developer. For example, it is about 0.1 to 10 g per liter.

If necessary, an optional development accelerator can be incorporated in the color developer.

Examples of the development accelerator include the thioether compounds described in JP-B-47-16088, 47-5987, 38-7826, 45-12380, 45-9019 and U.S. Pat. No. 3,813,247; the p-phenylenediamine compounds described in JP-A-52-49829 and 50-15554; the quaternary ammonium salts described in JP-A-50-137726, JP-B-44-30074, JP-A-56-156826 and No. 52-43429; the p-aminophenol compounds described in U.S. Pat. Nos. 2,610,122 and 4,119,462; the amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; the polyalkylene oxides described in JP-B-37-16088 and 42-25201, U.S. Pat. No. 3,128,183, JP-B-40-11431 and No. 42-23883 and U.S. Pat. No. 3,532,501; 1-phenyl-3-pyrazolidone compound, hydrazines, mesoionic compounds, ionic compound, and imidazoles.

The color developer is preferably substantially free of benzyl alcohol. The term "substantially free" means that the benzyl alcohol content is not more than 2.0 ml per liter of color developer or, more preferably, nil. When substantially free of benzyl alcohol, the color developer is advantageous in continuous processing, with minimum variations in photographic characteristics.

In the present invention, an appropriate antifogging can be used, as necessary, in addition to chloride and bromide ions. As the antifoggant, alkali metal halides such as potassium iodide and various organic antifoggants can be employed. Representative organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-triazolybenzimidazole, 2-thiazolylmethylbenzimidazole, indazole, hydroxyazaindolizine, and adenine.

The color developer to be used in the present invention preferably contains fluorescent brightener. The preferred examples of fluorescent brightener are 4,4'-diamino-2,2'-disulfostilbene compounds. The amount of the brightener added ranges from 0 to 10 g and preferably from 1 to 6 g/1.

If necessary, various surfactants such as alkylsulfonic acids, arylsulfonic acids, aliphatic carboxylic acids, and aromatic carboxylic acids may be added to the developer solution.

The processing temperature with the color developer according to the present invention is 20° to 50° C. and preferably 30° to 40° C. The developing time is 20 seconds to 5 minutes and preferably 30 seconds to 2 minutes.

In the present invention, the step of color development is followed by treatment for removal of silver salts. The silver removal treatment generally includes a bleaching step and a fixation step. It is particularly preferable, however, that the bleaching and fixation are performed simultaneously.

The bleach or bleach-fix bath used in the invention may contain a rehalogenating agent such as a bromide (e.g., potassium bromide, sodium bromide, ammonium bromide), a chloride (e.g., potassium chloride,sodium chloride, ammonium chloride) or an iodide (e.g., ammonium iodide). If necessary, this bath may further contain at least one buffer (for maintaining pH at a constant level), for example an inorganic or organic acid and an alkali metal or ammonium salt thereof, such as boric acid, borax, sodium metaborate, acetic acid, sodium acetate, sodium carbonate, potassium carbonate, phosphorous acid, phosphoric acid, sodium phosphate, citric acid, sodium citrate, or tartaric acid, and/or a corrosion inhibitor, such as ammonium nitrate or guanidine.

The fixing agent used in the bleach-fix bath or fix bath in the invention may be any of known fixing agents, i.e., water soluble silver halide dissolving agents, such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol) and thioureas. These may be used either alone or in combination. The particular bleach-fix bath described in JP-A-55-155354 containing a large quantity of a halide, such as potassium iodide, in combination with a fixing agent may also be used. In the practice of the invention, the use of a thiosulfate, in particular ammonium thiosulfate, is preferred. The fixing agent is used preferably in an amount of 0.3 to 2 moles, more preferably within the range of 0.5 to 1.0 mole, per liter of bath.

In the practice of the invention, the bleach-fix bath or fix bath preferably has a pH within the range of 3 to 10, more preferably within the range of 5 to 9. At lower pH levels, the silver removal is promoted but the degradation of the bath and the conversion of cyan dyes to their leuco forms are accelerated. Conversely, at higher pH levels, the silver removal is retarded and staining tends to occur with ease.

For pH adjustment, there may be added hydrochloric acid, sulfuric acid, nitric acid, acetic acid, bicarbonates, ammonia, potassium hydroxide, sodium hydroxide, sodium carbonate, or potassium carbonate as necessary.

The bleach-fix bath may further contain a fluorescent brightener, or optical brightener, an antifoaming agent, a surfactant, polyvinylpyrrolidone and/or an organic solvent such as methanol.

In the practice of the invention, the bleach-fix bath or fix bath contains, as a preservative, a sulfite ion-releasing compound, such as a sulfite (e.g., sodium sulfite, potassium sulfite, ammonium sulfite), a bisulfite (e.g., ammonium bisulfite, sodium bisulfite, potassium bisulfite) or a metabisulfite (e.g., potassium metabisulfite, sodium metabisulfite, ammonium metabisulfite). This compound is used preferably in a concentration of about 0.02 to 0.50 mole/liter, more preferably 0.04 to 0.40 mole/liter calculated in terms of the sulfite ion.

While sulfites are generally used as preservatives, ascorbic acid, carbonyl-bisulfite adducts, sulfinic acids, or carbonyl compounds may also be added.

Furthermore, a buffer, a fluorescent brightener, a chelating agent, an antifungal agent and so on may be added to the bath.

The silver halide photosensitive material for color photography according to the invention is generally subjected to a processing sequence of desilvering (fixation, bleach-fix) and washing with water and/or stabilization.

The quantity of water to be used in the washing stage is dependent on, and can be selected according to, the characteristics of the photosensitive material (which are dictated by the coupler and other components, for instance), intended use, washing water temperature, number of washing tanks (stages), replenishing system (counter-current or cocurrent) and other conditions. Particularly, the relation between the number of washing tanks and the quantity of water in the multi-stage counter-current system can be determined by the method described in *Journal of the Society of Motion Picture and Television Engineers* 64, p. 248–253, May, 1955.

The use of the multi-stage counter-current system disclosed in the above article would greatly reduces the required quantity of washing water but, because of an increased residence time of water in the tanks, favors the growth of bacteria, with the consequent risk of suspended matter being deposited on the photosensitive material. To overcome this disadvantage in the processing of the photosensitive material of this invention, one may advantageously employ a procedure for reducing the amount of calcium and magnesium ions as described in JP-A-62-288838. Furthermore, it is possible to employ a bactericide such as the isothiazolone compounds described in JP-A-57-8542 and the thiabendazole compounds, chlorine-containing bactericides such as chlorinated sodium isocyanurate, benzotriazole and other bactericides described in Hiroshi Hori: Chemistry of Antibacterial and Antifungal Agents, Hygienic Technology Association (ed.): Sterilization and Disinfection, and The Research Society of Antibacterial and Antifungal Agents, Japan: Encyclopedia of Antibacterial and Antifungal Agents.

The pH of the washing water used in the processing of the photosensitive material of the invention is 4 to 9 and preferably 5 to 8. While the washing water temperature and the washing time can also be selected according to the characteristics and intended use of the photosensitive material, these conditions ae generally 15°–45° C. and 20 sec.–10 min., and preferably 25°–40° C. and 30 sec.–5 min. Furthermore, the photosensitive material according to the present invention can be directly processed with a stabilization bath instead of the washing water bath. In such a stabilization process, any of the known procedures described in JP-A-57-8543, 58-14,834, 59-184343, 60-220345, 60-238832, 60-239784, 60-39749, 61-4054 and 61-11874 can be utilized. In particular, the use of a stabilization bath containing 1-hydroxyethylidene-1,1-diphosphonic acid, 5-chloro-2-methyl-4-isothazoline-3-one, a bismuth compound, or an ammonium compound is preferred.

Downstream of the washing stage, a stabilization stage is optionally provided, for example, a stabilizing bath containing formalin and a surfactant which is used as a final bath for the photographic color light-sensitive material.

The invention particularly includes a rapid processing process, in which the processing time (which is herein defined as the time period beginning when the photosensitive material comes into contact with the color developer and ending when the material leaves the final bath, which is generally, a washing bath or stabilization bath, is not longer than 4.5 minutes, preferably not longer than 4 minutes.

The silver halide photosensitive material for color photography used in the practice of the invention is now described in further detail.

The rapid processing process usually comprises following steps in sequence.

(A) Developing-Bleaching-Fixing-Washing (B) Developing-Bleach-fixing-Washing (C) Developing-Bleaching-Bleach-fixing-Washing After washing treatment, a stabilizing treatment may be taken place optionally.

The polymer to be used in the material may be one of those described in PCT WO-88/00723 and JP-A-63-44658.

While any polymers which are water insoluble solvent may be used in the practice of the invention, water insoluble and organic solvent soluble polymers may be preferably used and vinyl polymers and polyester polymers which contain the —C(=O)— bond as a repeating unit are particularly preferred to prevent sensitization streaks.

In preparing such vinyl polymers, two or more monomers suited for attaining various purposes (e.g., improvement in solubility) are used as mutual comonomers. A monomer having an acid group may also be used as a comonomer for modifying the color development characteristics or solubility characteristics in an amount that does not render the copolymer water-soluble.

If the vinyl monomer employed in the practice of the invention is a hydrophilic monomer (a monomer which, when used alone, gives a water-soluble homopolymer) used as a comonomer, the proportion of the hydrophilic monomer in the copolymer is not particularly critical unless the copolymer becomes water-soluble. Generally, however, the amount of the hydrophilic comonomer should preferably be not more than 40 mole percent, more preferably not more than 20 mole percent and, for still better results, not more than 10 mole percent. Where the hydrophilic comonomer to be copolymerized with other monomers in accordance with the invention has an acid group, the proportion of the acid group-containing comonomer should be in general not more than 20 mole percent, preferably not more than 10 mole percent, from the image preservation viewpoint. The absence of such comonomer is most preferred.

Preferred monomers used for preparing polymers suited for use in the practice of the invention are methacrylates, acrylamides and methacrylamides. Particularly preferred are acrylamides and methacrylamides.

The molecular weight or degree of polymerization of the polymer to be used in accordance with the invention does have any substantial influence on the effects of the present invention. However, an excessively high molecular weight may produce problems; for example, increased time is required for the polymer to be dissolved in an auxiliary solvent such as an ethylacetate, acetone, methanol, ethanol, cyclohexanone, methylethylketone, etc., or the polymer is difficult to emulsify or disperse due to a high solution viscosity, giving coarse grains. Coarse grains may reduce color forming capacity or spreadability. The use of an auxiliary solvent in large amounts to reduce the solution viscosity and eliminate such problems may possibly pose a new problem from the process viewpoint. In view of the above, the polymer, when 30 g thereof is dissolved in 100 cc of the auxiliary solvent employed, preferably has a viscosity of not more than 5,000 cps, more preferably not more than 2,000 cps. The polymer used in the practice of the invention should preferably have a molecular weight of not more than 150,000, more preferably not more than 100,000.

The water-insoluble polymer described herein should have a solubility of not more than 3 g, preferably not more than 1 g, in 100 g of distilled water.

The proportion of the polymer to the auxiliary solvent may vary within a wide range depending on the kind of polymer, its solubility in the auxiliary solvent, its degree of polymerization, the solubility of the coupler, and other factors. Generally, the auxiliary solvent is used in an amount such that a solution of at least the three components (coupler, high-boiling solvent for coupler, and polymer) in the auxiliary solvent has a sufficiently low viscosity for the solution to be readily dispersed in an aqueous hydrophilic colloid solution. Since the viscosity of such solution increases with the increase in the degree of polymerization of the polymer, the exact proportion of polymer to auxiliary solvent cannot be specified without variation for all polymer species. Generally, however, the range of about 1:1 to about 1:50 (by weight) is preferred. The proportion (by weight) of the polymer according to the invention to couplers is preferably 1:20 to 20:1, more preferably 1:10 to 10:1.

The following is a partial listing of specific examples of the polymer to be used in accordance with the invention, but the present invention is not to be construed as being limited thereto.

(P-1) Polymethyl methacrylate
(P-2) Polyethyl methacrylate
(P-3) Polyisopropyl methacrylate
(P-4) Polymethyl chloroacrylate
(P-5) Poly(2-tert-butylphenyl acrylate)
(P-6) Poly(4-tert-butylphenyl acrylate)
(P-7) Ethyl methacrylate-n-butyl acrylate copolymer (70:30)
(P-8) Methyl methacrylate-acrylonitrile copolymer (65:35)
(P-9) Methyl methacrylate-styrene copolymer (90:10)
(P-10) N-tert-Butyl methacrylamide-methyl methacrylate acrylic acid copolymer
(P-11) Methyl methacrylate-styrene-vinyl sulfonamide copolymer (70:20:10)
(P-12) Methyl methacrylate-cyclohexyl methacrylate copolymer (50:50)
(P-13) Methyl methacrylate-acrylic acid copolymer (95:5)
(P-14) Methyl methacrylate-n-butyl methacrylate copolymer (65:35)
(P-15) Methyl methacrylate-N-vinyl-2-pyrrolidone copolymer (90:10)
(P-16) Poly(N-sec-butylacrylamide)
(P-17) Poly(N-tert-butylacrylamide)
(P-18) Polycyclohexyl methacrylate-methyl methacrylate copolymer (60:40)
(P-19) n-Butyl methacrylate-methyl methacrylate-acrylamide copolymer (20:70:0)
(P-20) Diacetoneacrylamide-methyl methacrylate copolymer (20:80)
(P-21) N-tert-Butyl acrylamide-methyl methacrylate copolymer (40:60)
(P-22) Poly(N-n-butylacrylamide)
(P-23) tert-Butyl methacrylate-N-tert-butylacrylamide copolymer (50:50)
(P-24) tert-Butyl methacrylate-methyl methacrylate copolymer (70:30)
(P-25) Poly(N-tert-butylmethacrylamide)
(P-26) N-tert-Butylacrylamide-methyl methacrylate copolymer (60:40)
(P-27) Methyl methacrylate-acrylonitrile copolymer (70:30)
(P-28) Methyl methacrylate-styrene copolymer (75:25)
(P-29) Methyl methacrylate-hexyl methacrylate copolymer (70:30)
(P-30) Poly(4-biphenyl acrylate)
(P-31) Poly(2-chlorophenyl acrylate)
(P-32) Poly(4-chlorophenyl acrylate)
(P-33) Poly(pentachlorophenyl acrylate)
(P-34) Poly(4-ethoxycarbonylphenyl acrylate)
(P-35) Poly(4-methoxycarbonylphenyl acrylate)
(P-36) Poly(4-cyanophenyl acrylate)
(P-37) Poly(4-methoxyphenyl acrylate)
(P-38) Poly(3,5-dimethyladamantyl acrylate)
(P-39) Poly(3-dimethylaminophenyl acrylate)
(P-40) Poly(2-naphthyl acrylate)
(P-41) Poly(phenyl acrylate)
(P-42) Poly(N,N-dibutylacrylamide)
(P-43) Poly(isohexylacrylamide)
(P-44) Poly(isooctylacrylamide)
(P-45) Poly(N-methyl-N-phenylacrylamide)
(P-46) Poly(adamantyl methacrylate)
(P-47) Poly(sec-butyl methacrylate)
(P-48) N-tert-butylacrylamide-acrylic acid copolymer (97:3)
(P-49) Poly(2-chloroethyl methacrylate)
(P-50) Poly(2-cyanoethyl methacrylate)
(P-51) Poly(2-cyanomethylphenyl methacrylate)
(P-52) Poly(4-cyanophenyl methacrylate)
(P-53) Poly(cyclohexyl methacrylate)
(P-54) Poly(2-hydroxypropyl methacrylate)
(P-55) Poly(4-methoxycarbonylphenyl methacrylate)
(P-56) Poly(3,5-dimethyladamantyl methacrylate)
(P-57) Poly(phenyl methacrylate)
(P-58) Poly(4-butoxycarbonylphenylmethacrylamide)
(P-59) Poly(4-carboxyphenylmethacrylamide)
(P-60) Poly(4-ethoxycarbonylphenylmethacrylamide)
(P-61) Poly(4-methoxycarbonylphenylmethacrylamide)
(P-62) Poly(cyclohexyl chloroacrylate)
(P-63) Poly(ethyl chloroacrylate)
(P-64) Poly(isobutyl chloroacrylate)
(P-65) Poly(isopropyl chloroacrylate)
(P-66) Poly(phenylacrylamide)
(P-67) Poly(cyclohexylacrylamide)
(P-68) Poly(phenylmethacrylamide)
(P-69) Poly(cyclohexylmethacrylamide)

(P-70) $\left(CH_2CH\right)$ with $CONHC_4H_9(t)$

Examples of the cyan coupler which are advantageous in the practice of the invention for rapid processing include cyan couplers of formulae (Va) or (Vb):

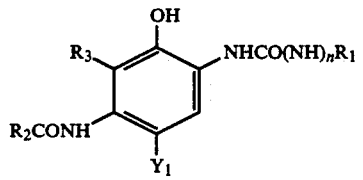

(Va)

-continued

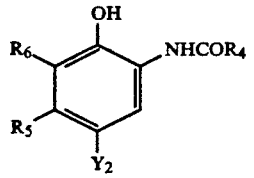

(Vb)

In the above formulae (Va) and (Vb), $R_1$, $R_2$ and $R_4$, which may be the same or different, each is substituted or unsubstituted, aliphatic, aromatic or heterocyclic group; $R_3$, $R_5$ and $R_6$, which may be the same or different, each is hydrogen, a halogen atom, an aliphatic or aromatic group or an acylamino group; $R_3$ may be linked to $R_2$, to form a nitrogen-containing five- or six-membered ring; $Y_1$ and $Y_2$ each is hydrogen or a coupling-off group capable of being eliminated by a coupling reaction with an oxidized color developing agent and n is 0 or 1.

Referring to $R_1$, $R_2$ and $R_4$ in the cyan couplers of the above formulae (Va) and (Vb), the aliphatic group preferably contains 1 to 32 carbon atoms and includes, among others, methyl, butyl, tridecyl, cyclohexyl and allyl; the aryl group includes phenyl, and naphthyl; and the heterocyclic group includes 2-pyridyl, 3-imidazolyl, 2-furyl and 6-quinolyl. These groups may further have one or more substituents each selected from among alkyl groups, aryl groups, heterocyclic groups, alkoxy groups (e.g., methoxy, 3-methoxyethoxy), aryloxy groups (e.g., 2,4-di-tert-amylphenoxy, 2-chlorophenoxy, 4-cyanophenoxy, alkenyloxy groups (e.g., 2-propenyloxy), acryl groups (e.g., acetyl, benzoyl), ester groups (e.g., butoxy-carbonyl, phenoxycarbonyl, acetoxy, benzolyloxy, butoxysulfonyl, toluenesulfonyloxy), amido groups (e.g., acetylamino, methanesulfonamido, dipropylsulfamoylamino) carbamoyl groups (e.g., dimethylcarbamoyl, ethylcarbamoyl), sulfamoyl groups (e.g., butylsulfamoyl), imido groups (e.g., succinimido, hydantoinyl), ureido groups (e.g., phenylureido, dimethylureido), aliphatic or aromatic sulfonyl groups (e.g., methanesulfonyl, phenylsulfonyl), aliphatic or aromatic thio groups (e.g., ethylthio, phenylthio), a hydroxyl group, cyano group, carboxyl group, nitro group, sulfo group, or halogen atom.

Where $R_3$ in formula (Va) or $R_5$ in general formula (Vb) is a substituent which is substitutable, it may have one or more substituents each selected from among those substituents mentioned above as optional substituents on $R_1$.

It is preferably that $R_5$ in formula (Vb) is an aliphatic group, such as, for example, methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

In formula (Va) and formula (Vb), $Y_1$ and $Y_2$ each is hydrogen or a coupling-off group (as used herein, inclusive of an atom) capable of being eliminated by a coupling reaction. Examples are halogen atoms (fluorine, chlorine, bromine), alkoxy groups (ethoxy, dodecyloxy, methoxyethylcarbamoylmethoxy, carboxypropyloxy, methylsulfonylethoxy), aryloxy groups (4-chlorophenoxy, 4-methoxyphenoxy, 4-carboxyphenoxy), acyloxy groups (acetoxy, tetradecanoyloxy, benzoyloxy), sulfonyloxy groups (methanesulfonyloxy, toluenesulfonyloxy), amido groups (dichloroacetylamino, heptafluorobutylamido, methanesulfonylamino, toluenesulfonylamino), alkoxycarbonyloxy groups (ethoxycarbonyloxy, benzyloxycarbonyloxy), aryloxycarbonyloxy groups (phenoxycarbonyloxy), aliphatic or aromatic thio groups (ethylthio, phenylthio, tetrazolylthio), imido groups (succinimido, hydantoinyl) and aromatic azo groups (phenylazo). These leaving groups may contain a group or groups useful for photographic purposes.

Preferred as $R_1$ in formula (Va) are aryl groups and heterocyclic groups. More preferred are substituted aryl groups the substituent or substituents of which are each selected from among halogen atoms, alkyl groups, alkoxy groups, aryloxy groups, acylamino groups, acryl groups, carbamoyl groups, sulfonamido groups, sulfamoyl groups, sulfonyl groups, sulfamido groups, oxycarbonyl groups and cyano groups.

In cases where, in formula (Va), $R_3$ and $R_2$ do not form a ring, $R_2$ is preferably a substituted or unsubstituted alkyl or aryl group, more preferably a substituted aryloxy-substituted alkyl group, while $R_3$ is preferably hydrogen.

Preferred as $R_4$ in formula (Vb) are substituted or unsubstituted alkyl or aryl groups. Particularly preferred are substituted aryloxy-substituted alkyl groups.

Preferred as $R_5$ in formula (Vb) are substituted or unsubstituted alkyl groups containing 1 to 15 carbon atoms and substituted methyl groups the substituent or substituents of which each contains 1 or more carbon atoms. Preferred substituents are arylthio groups, alkylthio groups, acylamino groups, aryloxy groups and alkyloxy groups.

More preferred as $R_5$ in formula (Vb) are substituted or unsubstituted alkyl groups containing 1 to 15 carbon atoms, in particular substituted or unsubstituted alkyl groups containing 2 to 4 carbon atoms. A substituted or unsubstituted ethyl group is most preferred.

Preferred as $R_6$ in formula (Vb) are hydrogen and halogen atoms. Chlorine and fluorine are particularly preferred.

Preferred as $Y_1$ and $Y_2$ in formulae (Va) and (Vb), respectively, are hydrogen, halogen atoms, alkoxy groups, aryloxy groups, acyloxy groups, and sulfonamido groups.

In formula (Vb), $Y_2$ is preferably a halogen atom, in particular chlorine or fluorine.

In cases where $n=0$ in formula (Va), $Y_1$ is more preferably a halogen atom, in particular chlorine or fluorine.

Preferred examples of the cyan coupler of formulae (Va) or Vb) are shown below.

The following specific examples of the oil-soluble cyan coupler used in accordance with the invention are not to be construed as limiting the scope of the present invention.

(C-1)
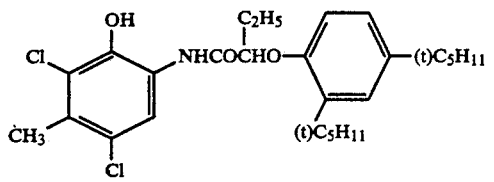
(C-2)
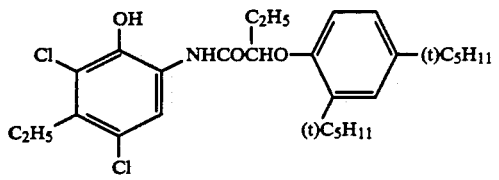
(C-3)
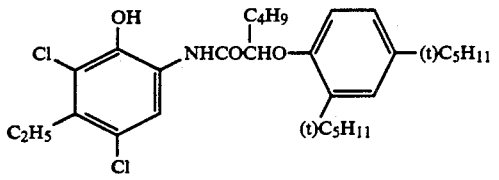
(C-4)
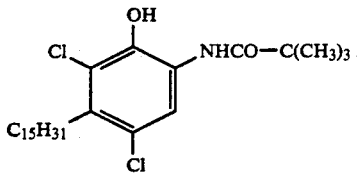
(C-5)
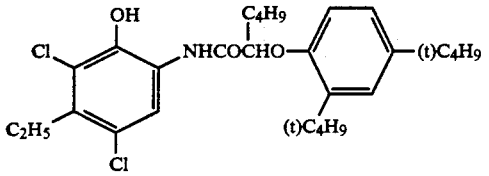
(C-6)
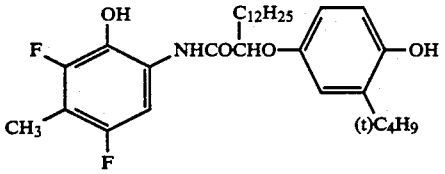
(C-7)
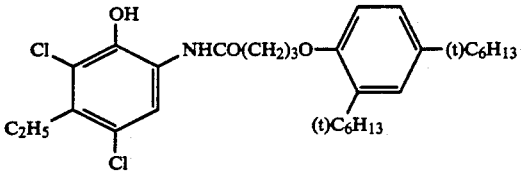
(C-8)
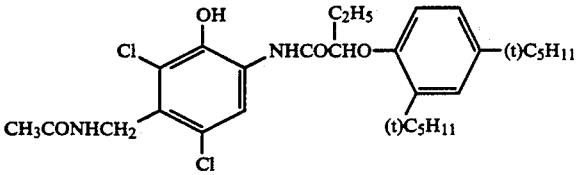

-continued
(C-9)
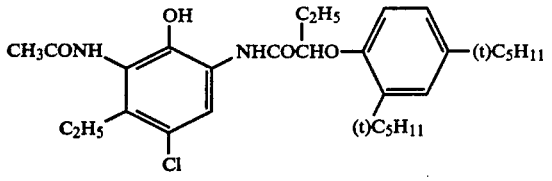
(C-10)
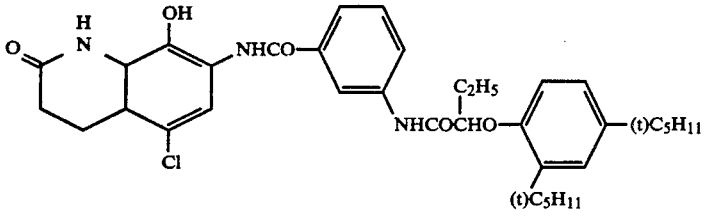
(C-11)
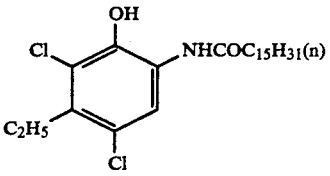
(C-12)
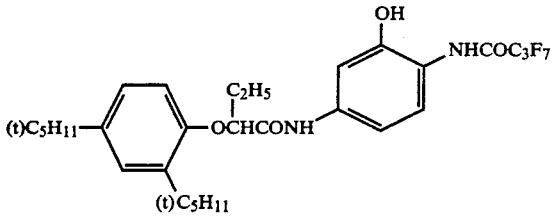
(C-13)
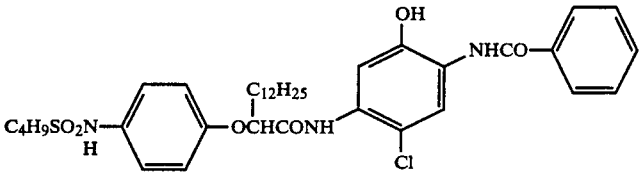
(C-14)
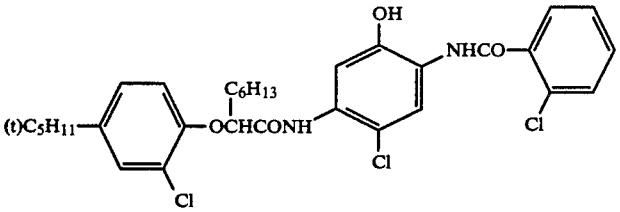
(C-15)
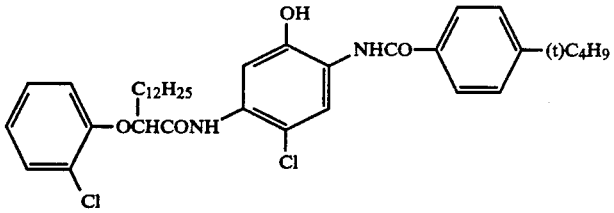
(C-16)
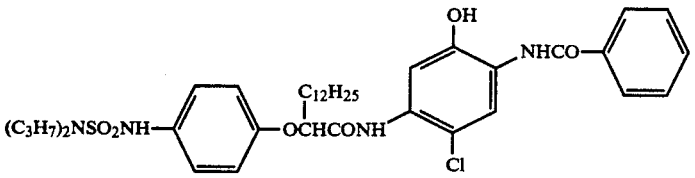

-continued
(C-17)
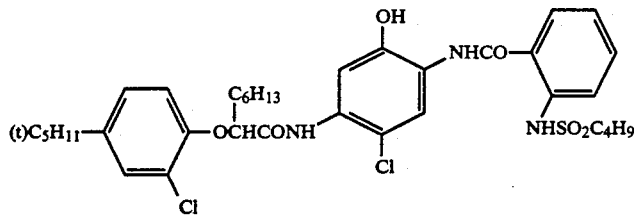
(C-18)
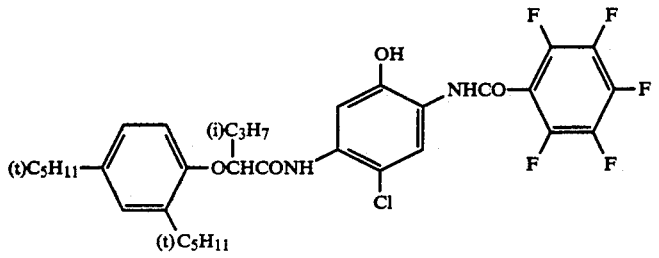
(C-19)
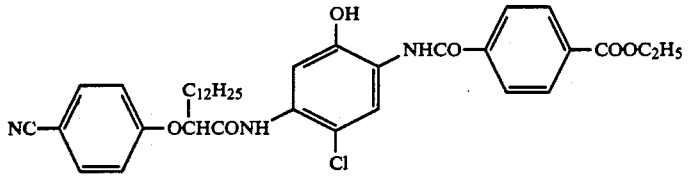
(C-20)
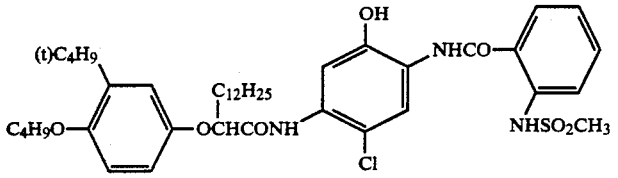
(C-21)
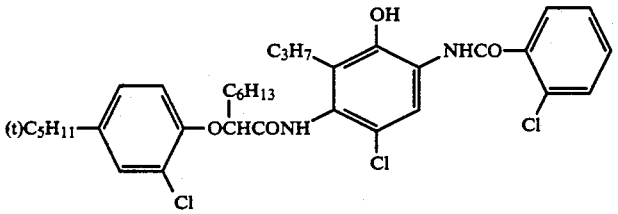
(C-22)
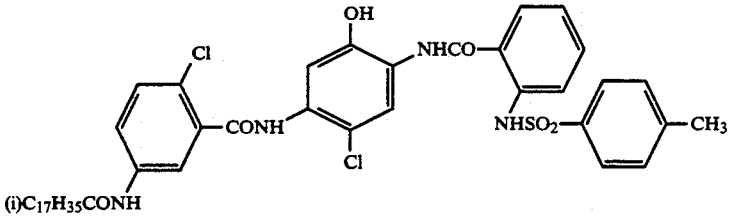
(C-23)
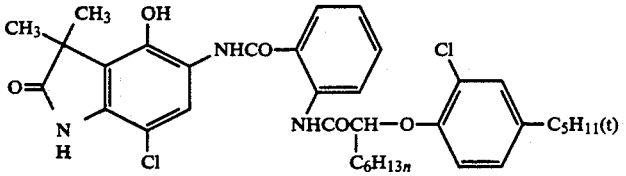

-continued
(C-24)
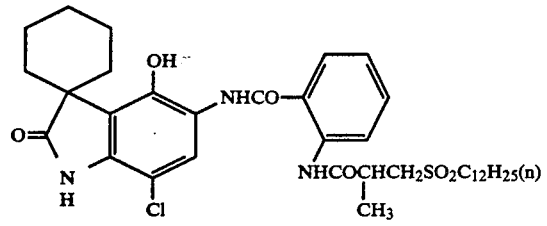
(C-25)
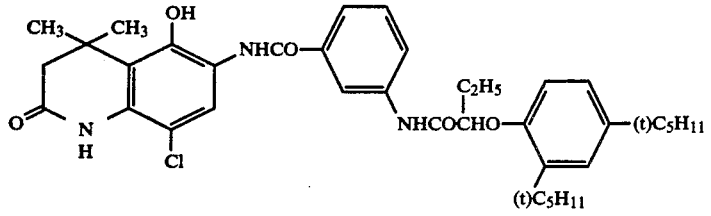
(C-26)
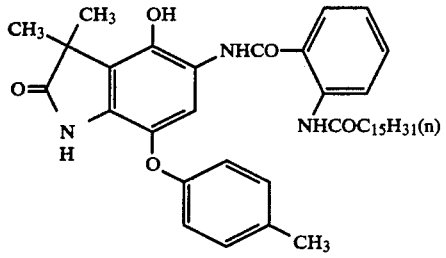
(C-27)
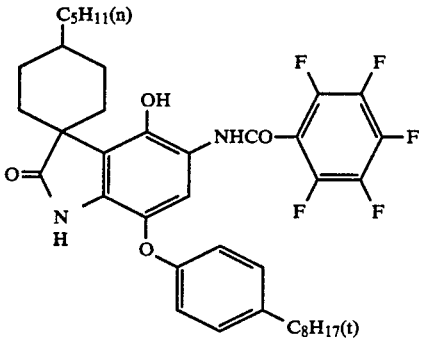
(C-28)
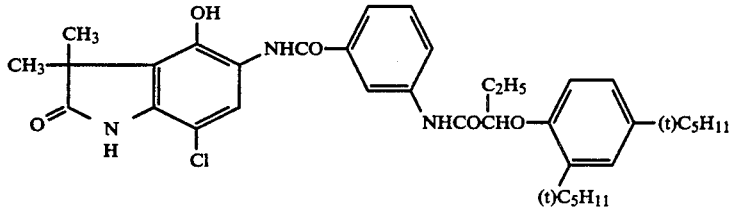
(C-29)
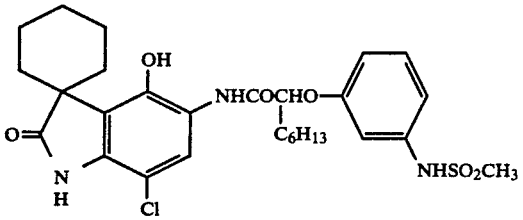

-continued
(C-30)
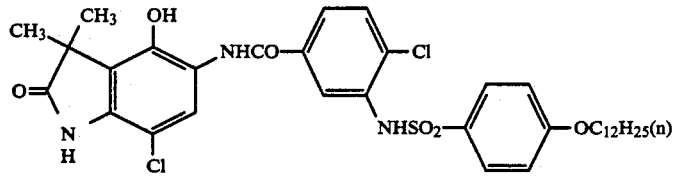
(C-31)
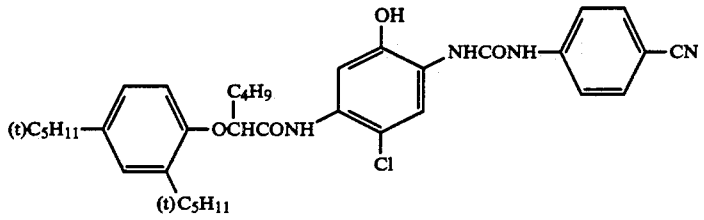
(C-32)
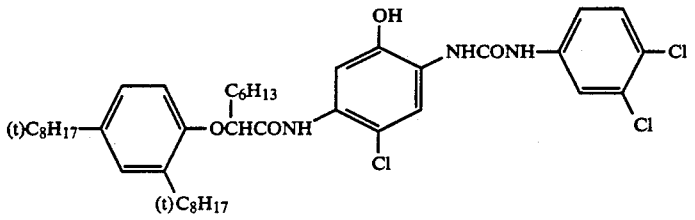
(C-33)
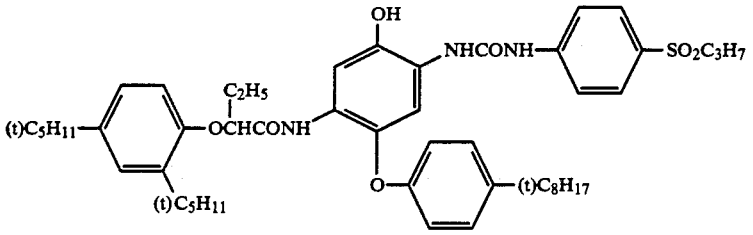
(C-34)
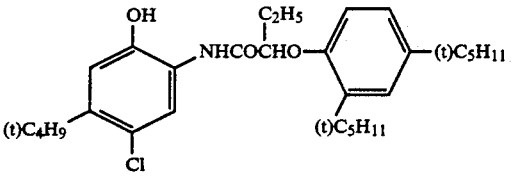
(C-35)
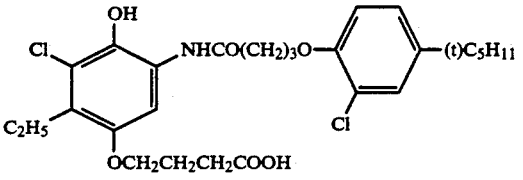
(C-36)
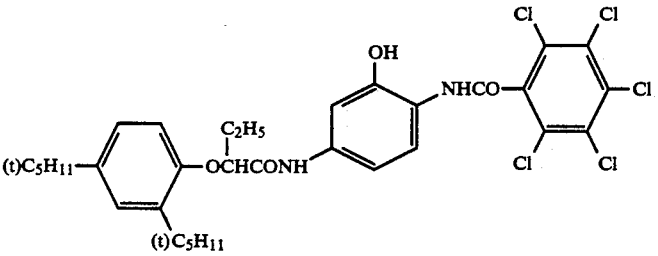

-continued
(C-37)
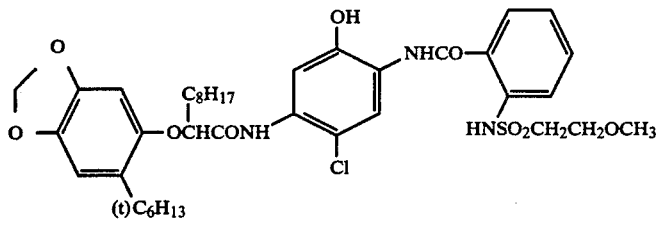
(C-38)
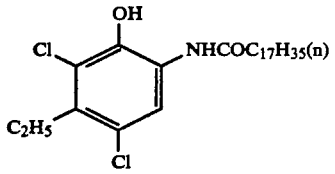
(C-39)
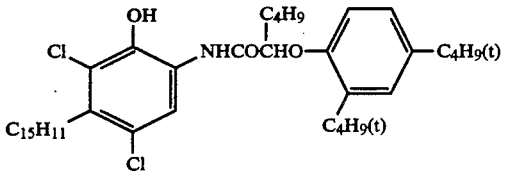
(C-40)
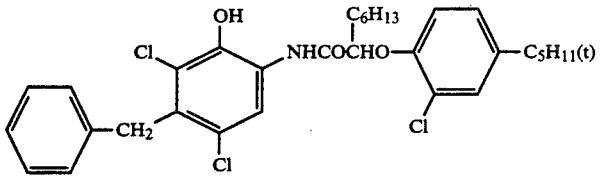
(C-41)
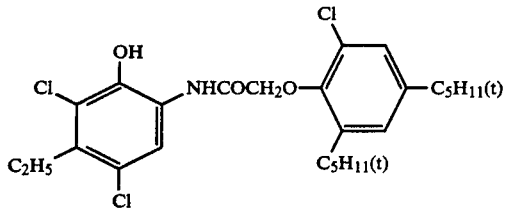
(C-42)
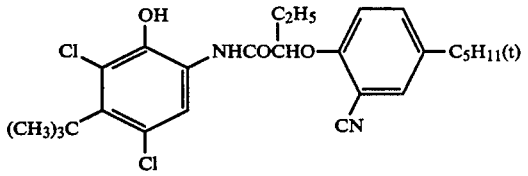
(C-43)
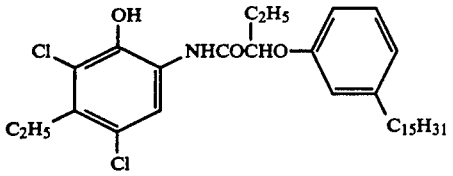
(C-44)
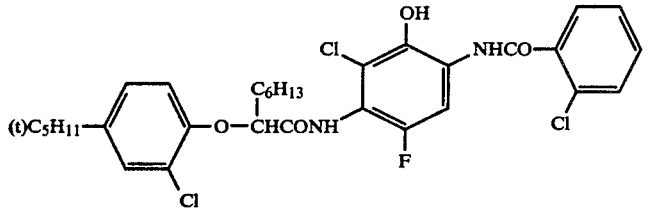

-continued (C-45)

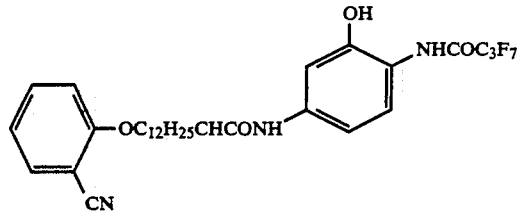

(C-46)

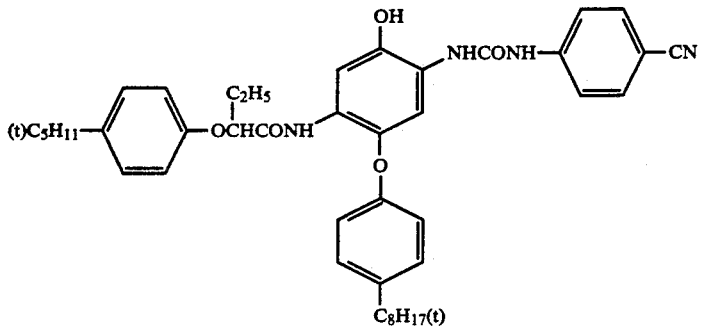

(C-47)

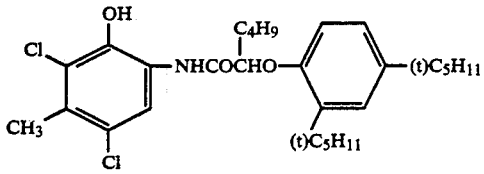

The color photographic light-sensitive material according to the invention can contain, in addition to the above mentioned cyan couplers, one or more yellow couplers and one or more magenta couplers.

Preferred yellow couplers are pivaloyacetanilide couplers and benzoylacetanilide couplers. For developed color image fastness, the former are more preferred, however. Those couplers which have a nitrogen-releasing leaving group for coupling are particularly preferred since they have high activity.

Preferred magenta couplers are 3-anilino-5pyrazolone couplers, 3-acylamino-5-pyrazolone couplers, pyrazolotriazole couplers and the like. Among them, pyrazolotriazole couplers are more preferred because of smaller side absorption on the shorter wavelength side and superiority in fastness of developed color images, among others.

In the practice of the invention, those high-boiling solvents described in U.S. Pat. No. 2,322,027, JP-A-62-215,272 (pages 137–144), JP-A-62-283,329, JP-A-63-11,939 and JP-A-63-143,545 and European Patent No. 0228,064 can be used.

Compounds of formulas (VIa) to (VIf) given below are high-boiling solvents useful in the practice of the present invention.

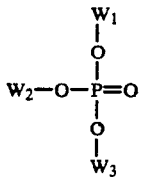

Formula (VIa)

$W_1—COOW_2$ Formula (VIb)

-continued

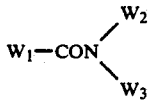

Formula (VIc)

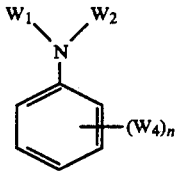

Formula (VId)

$W_1—O—W_2$ Formula (VIe)

$HO—W_6$ Formula (VIf)

In the above formulae, $W_1$, $W_2$ and $W_3$, which may be the same or different, each is a substituted or unsubstituted alkyl, cycloalkyl, alkenyl, aryl or heterocyclic group; $W_4$ is $W_1$, O-$W_1$ or S-$W_1$; and n is an integer of 1 to 5. When n is 2 or more, plural $W_4$ groups may be the same or different. In general formula (VIe), $W_1$ and $W_2$, may be linked to form a condensed ring together with the adjacent oxygen atom. $W_6$ is a substituted or unsubstituted alkyl or aryl group and the number of carbon atoms in $W_6$ is not less than 12.

In the practice of the invention, the high-boiling coupler solvent is used in an amount which may vary within a wide range depending on the couplers and polymer and the amounts thereof. Preferably, however, the high-boiling coupler solvent/coupler weight ratio is 0.05 to 20, more preferably 0.1 to 10, and the high-boiling coupler solvent/polymer weight ratio to 0.02 to 40, more preferably 0.05 to 20. The high-boiling coupler solvent may be a single substance or a mixture of a plurality of substances.

Preferred compounds of formulas (VIa) to (VIf) are compounds of formula (VIa), (VIb) and (VIf).

Particularly preferred are compounds of formula (VIa) and compounds of the following formula (VIg), which is a subclass of the compounds of formula (VIb).

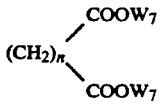

Formula (VIg)

In the above formula, n is an integer of 3 to 15, and $W_7$ is a substituted or unsubstituted alkyl group containing 4 to 15 carbon atoms.

Specific examples of the substituted or unsubstituted alkyl, cycloalkyl, alkenyl, aryl and heterocyclic groups represented by $W_1$ and $W_6$ in formulae (VIa) to (VIf) include those groups specifically mentioned above referring to general formulae (Va) and (Vb). The alkyl groups may have an epoxy group.

Typical examples of the high-boiling coupler solvent which are particularly suited for use in the practice of the invention are listed below, but the present invention is not to be construed as being limited thereto.

$O{=}P(OC_4H_9\text{-}n)_3$ (S-1)

$O{=}P(OCH_2CH_2CH(CH_3)CH_3)_3$ (S-2)

$O{=}P(OC_6H_{13}\text{-}n)_3$ (S-3)

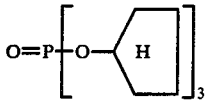

(S-4)

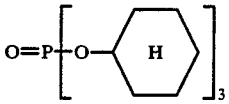

(S-5)

$O{=}P(OC_8H_{17}\text{-}n)_3$ (S-6)

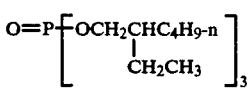

(S-7)

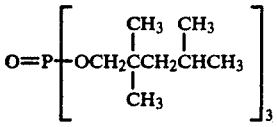

(S-8)

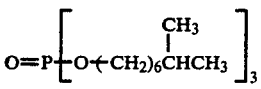

(S-9)

$O{=}P(OC_9H_{19}\text{-}n)_3$ (S-10)

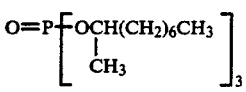

(S-11)

$O{=}P(OC_{10}H_{21}\text{-}n)_3$ (S-12)

-continued

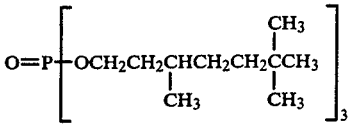

(S-13)

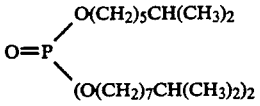

(S-14)

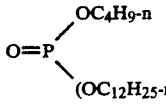

(S-15)

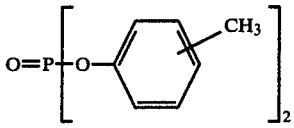

(S-16)

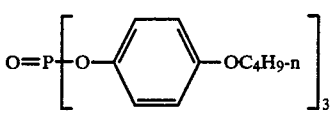

(S-17)

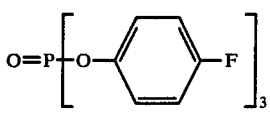

(S-18)

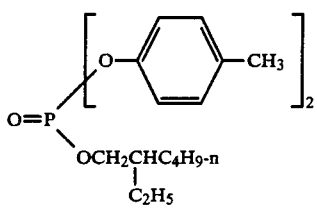

(S-19)

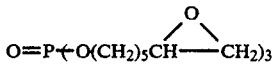

(S-20)

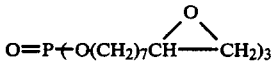

(S-21)

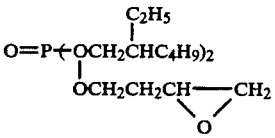

(S-22)

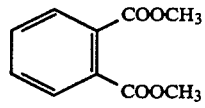

(S-23)

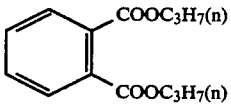

(S-24)

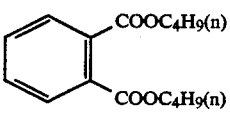

(S-25)

-continued
(S-26)
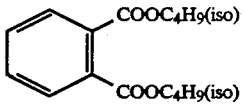
(S-27)
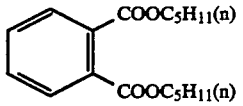
(S-28)
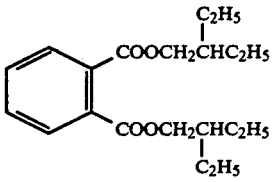
(S-29)
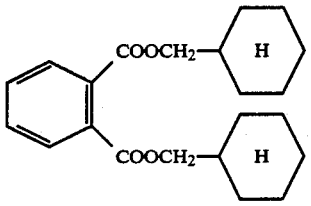
(S-30)
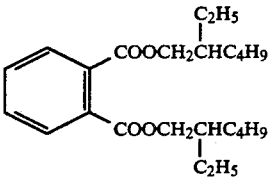
(S-31)
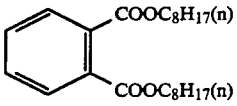
(S-32)
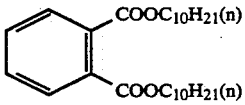
(S-33)
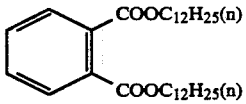
(S-34)
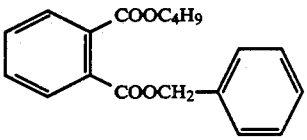
(S-35)
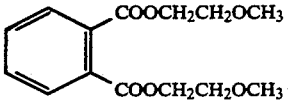
(S-36)
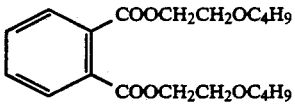
-continued
(S-37)
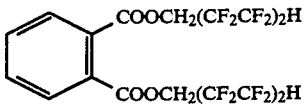
(S-38)
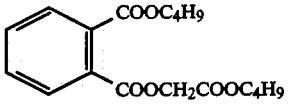
(S-39)
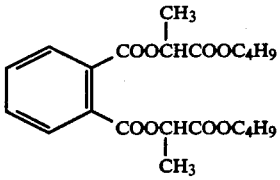
(S-40)
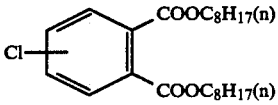
(S-41)
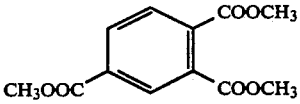
(S-42)
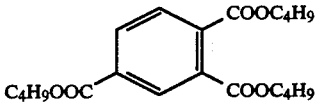
(S-43)
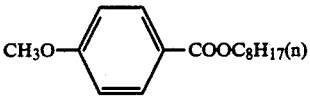
(S-44)
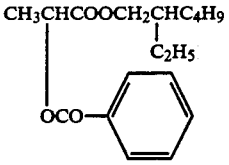
(S-45)
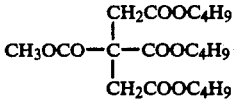
(S-46)
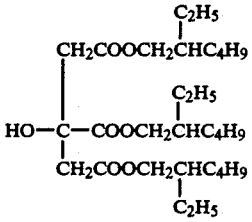
(S-47)
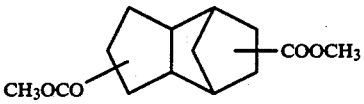
(S-48)
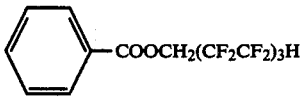

-continued
$CHCOOCH_2(CF_2CF_2)_2H$ (S-49)
‖
$CHCOOCH_2(CF_2CF_2)_2H$
(S-50)
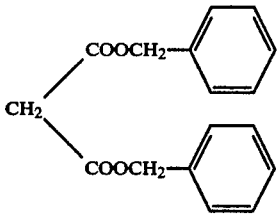
(S-51)
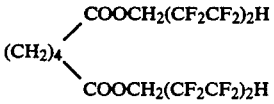
(S-52)
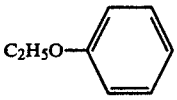
(S-53)
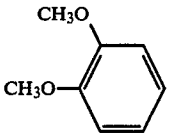
(S-54)
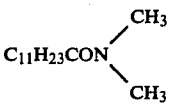
$C_{12}H_{25}OH$ (S-55)
$C_{16}H_{33}OH$ (S-56)
$C_{18}H_{37}OH$ (S-57)
$C_{10}H_{21}O(CH_2)_5O(CH_2)_2OH$ (S-58)
(S-59)
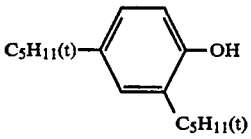
(S-60)
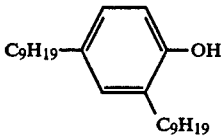
$CH_3(CH_2)_{17}Cl$ (S-61)
$CH_3(CH_2)_{15}Br$ (S-62)
(S-63)
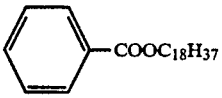
-continued
(S-64)
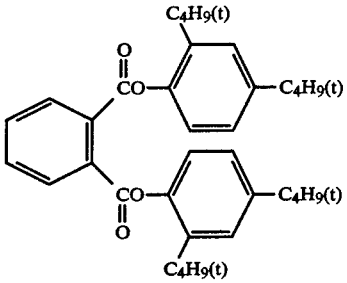
(S-65)
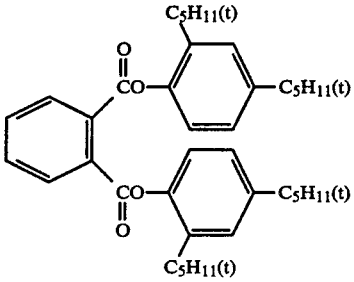
(S-66)
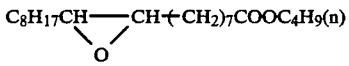
(S-67)
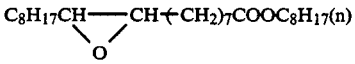
(S-68)
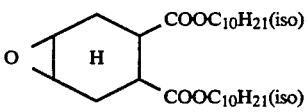
(S-69)
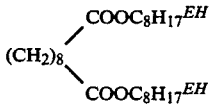
(S-70)
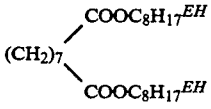
(S-71)
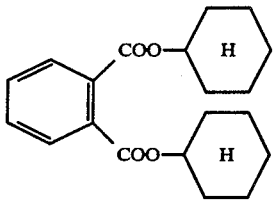
(S-72)
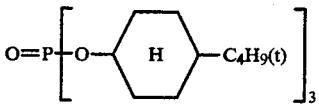
(S-73)
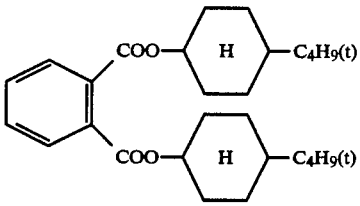

-continued

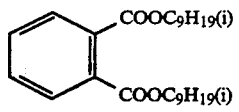

(S-74)

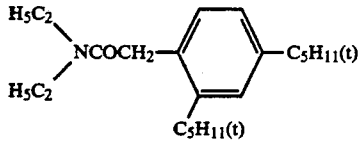

(S-75)

In the above list, $C_8H_{17}^{EH}$ represent an ethylhexyl group.

In addition to the compounds of formulae (VIa) to (VIg), any other water-immiscible compound may be used as the high-boiling solvent in the practice of the invention if it has a melting point not higher than 100° C. and a boiling point not lower than 140° C. and can serve as a good solvent for couplers. The high-boiling coupler solvent preferably has a melting point not higher than 80° C. and a boiling point not lower than 160° C., more preferably not lower than 170° C.

In addition to the above-mentioned polymer, couplers and high-boiling solvent, a variety of materials can be added to the silver halide photographic light-sensitive material of the present invention, including those disclosed in *Research Disclosure* (RD) No. 17643 and No. 18716, as indicated in the table below.

Known photographic additives which can be used in the invention are also disclosed in the above two issues of Research Disclosure, as summarized in the same table.

| Additives | RD17643 | RD18716 |
|---|---|---|
| 1. Chemical sensitizer | p 23 | p 648, right column |
| 2. Sensitivity enhancer | | p 648, right column |
| 3. Spectral sensitizer Color sensitizer | p 23–24 | p 648, right column–p 649, right column |
| 4. Optical brightener | p 24 | |
| 5. Antifoggant Stabilizer | p 24–25 | p 649, right column– |
| 6. Light absorber Filter dye UV absorber | p 25–26 | p 649, right column–p 650, left column |
| 7. Stain inhibitor | p 25, right column | p 650, left–right columns |
| 8. Dye image stabilizer | p 25 | |
| 9. Hardener | p 26 | p 651, left column |
| 10. Binder | p 26 | p 651, left column |
| 11. Plasticizer Lubricant | p 27 | p 650, right column |
| 12. Coating auxiliaries Surfactant | p 26–27 | p 650, right column |
| 13. Antistatic agent | p 27 | p 650, right column |

In the practice of the present invention, various color couplers can be employed. Specific examples of such color couplers can be found in the patents mentioned in Research Disclosure No. 17643, VII-C to G.

Preferred yellow couplers are those described, for example, in U.S. Pat. Nos. 3,933,501, 4,022,620, 4,326,024, 4,401,752, JP-B-58-10739 and British Patent Nos. 1,425,020 and 1,476,760.

Preferred magenta couplers include 5-pyrazolone and pyrazole compounds. The specific compounds described in U.S. Pat. Nos. 4,310,619 and 4,351,897, European Patent No. 73,639, U.S. Pat. No. 3,061,432 and 3,725,064, Research Disclosure No. 24220 (June, 1984), JP-A-60-33552, Research Disclosure No. 24230 (June, 1984), JP-A-60-43659, and U.S. Pat. Nos. 4,500,630 and 4,540,654 are particularly useful.

Cyan couplers include phenol and naphthol couplers and are preferably those mentioned in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,720, European Patent No. 121,365A, U.S. Pat. Nos. 3,446,622, 4,333,999, 4,451,559 and 4,427,767, and European Patent No. 161,626A.

Colored couplers for correction for unwanted absorptions of developed dyes are preferably those mentioned in Research Disclosure No. 17643, VII-G, U.S. Pat. No. 4,163,670, JP-B-57-39413, U.S. Pat. Nos. 4,004,929 and 4,138,258, and British Patent No. 1,146,368.

Preferred couplers assuring the proper diffusibility of developed dyes are described in U.S. Pat. No. 4,366,237, British Patent No. 2,125,570, European Patent No. 96,570, and West German Patent Application (OLS) No. 3,234,533.

Typical examples of dye-forming polymer couplers are mentioned in U.S. Pat. Nos. 3,451,820, 4,080,211 and 4,367,282 and British Patent No. 2,102,173.

Those couplers which release photographically useful residues upon coupling reaction can also be used with advantage in the practice of the present invention. Preferred examples of the DIR couplers which release development inhibitors are disclosed in the patents cited in Research Disclosure Nos. 17643, VII-F, referred to hereinbefore, viz. JP-A-57-151944, 57-154234 and 60-184248, and U.S. Pat. No. 4,248,962.

Preferred examples of the couplers which release nucleating agents or development accelerators imagewise in development are mentioned in British Patent Nos. 2,097,140 and 2,131,188, and JP-A-59-157638, 59-170847.

Other couplers which can be incorporated in the photosensitive material of the invention include the competitive couplers mentioned in U.S. Pat. No. 4,130,427, polyequivalent couplers mentioned in U.S. Pat. Nos. 4,283,472, 4,338,393 and 4,310,618, DIR redox compound-releasing couplers described in JP-A-60-18950 and couplers adapted to release dyes which regain colors after cleavage as mentioned in European Patent No. 173,302A.

These couplers can be incorporated in the photosensitive material of the invention by various known dispersing methods.

The procedures and effects of the latex dispersion process and examples of latices are described in U.S. Pat. No. 4,199,363, and West German Patent Application (OLS) Nos. 2,541,274 and 2,541,230.

In accordance with the invention, the silver halide emulsion is composed substantially of silver chloride. The term "substantially" as used herein means that the silver chloride content relative to the total amount of silver halides is not less than 80 mole percent, preferably not less than 95 mole percent and, for still better results not less than 98 mole percent. From the rapid processing viewpoint, the silver chloride content is desirably as high as possible. Furthermore, the silver chloride-rich emulsion according to the invention may contain minor amounts of silver bromide and silver iodide. This may at times be very useful for sensitivity to light, since it improves the amount of light absorption, increases the adsorption of spectral sensitizing dyes or attenuates the desensitization due to spectral sensitizing dyes.

In the practice of the invention, the silver halide emulsion is used in a coating amount of not more than 0.8 g/m$^2$ as silver, preferably in the range of 0.3 g/m$^2$ to 0.75 g/m$^2$ as silver.

The use of the photosensitive material containing the polymer according to the invention in a coating amount not exceeding 0.8 g/m$^2$ as silver is very advantageous for rapid development and for preventing sensitization streaks.

The silver halide contained in the photographic emulsion layer of the photographic light-sensitive material used in the practice of the invention may have different phases for the grain core and the surface, a polyphasic structure having junctions, or a homogeneous phase as a whole. These different structures may be present together.

The morphology of the silver halide grains in the photographic emulsion may be regular in crystalline form, for example cubic, octahedral or tetradecahedral, or irregular, for example spherical or tabular, or include, for example twin planes. It may be a composite of such forms.

The silver halide grains may be fine and have a size not exceeding about 0.2 micron or may be large in size such that the diameter equivalent to the projected area is up to about 10 microns. They may be in the form of a polydisperse emulsion or a monodisperse emulsion.

The silver halide photographic emulsion in the invention can be prepared, for example, by the method described in Research Disclosure No. 17643 (Dec. 1978), pages 22–23, "I. Emulsion preparation and types".

Monodisperse emulsions described in U.S. Pat. Nos. 3,574,628 and 3,655,394 and British Patent No. 1,413,748, for instance, are also preferred.

Tabular grains having an aspect ratio of about 5 or more can also be used in the practice of the invention. Such tabular grains can be prepared readily by the methods described in Gutoff: Photographic Science and Engineering, 14, 248–257 (1970), U.S. Pat. Nos. 4,434,226, 4,414,310, 4,433,048 and 4,439,520 and British Patent No. 2,112,157, among others.

The crystalline structure may be uniform or the core and surface may differ in halogen composition. A laminar structure is also useful. The crystal grains may have an epitaxially grown layer of a silver halide different in composition or be junctioned with a compound other than a silver halide, for example silver rhodanate or lead oxide.

A mixture of grains having different crystalline forms may also be used.

The supports which can be appropriately used for purposes of the invention are described, for example, in Research Disclosure No. 17643 at page 68 and no. 18716 at page 647, R column to page 648, L column.

The photosensitive material to which the present invention is applicable includes, among others, color negative films, reversal color films (internal type and external type), color papers, color positive films, reversal color papers, color diffusion transfer materials, direct positive color photosensitive materials and other color photographic light-sensitive materials. The invention is preferably applied to color negative films, reversal color films and reversal color papers.

The following specific examples are intended to illustrate the invention in further detail, and are not to be construed as limiting the scope of the invention. Unless otherwise indicated, all parts, percents and ratios are by weight.

EXAMPLE 1

Using a paper base laminated with polyethylene on both sides, the following multi-layer color printing paper 101 was prepared. The coating compositions were prepared in the following manner.

First layer coating solution

In a mixture of 150 cc of ethyl acetate, 1.0 cc of solvent S-74 and 3.0 cc of solvent S-75 were dissolved 60.0 g of yellow coupler ExY and 28.0 g of fading inhibitor Cpd-1, and the solution was added to 450 cc of a 10% aqueous gelatin solution containing sodium dodecylbenzenesulfonate. The mixture was dispersed by means of a sonic homogenizer and the resulting dispersion was mixed with 420 g of a silver chlorobromide emulsion (silver bromide content 0.7 mole %) containing the blue-sensitive sensitizing dye described below to prepare a first layer coating solution. Coating solutions for the second through seventh layers were also prepared in a similar manner. As the gelatin hardener for each coating solution, 1,2-bis(vinylsulfonyl)ethane was used.

The spectral sensitizing dyes for the respective layers are shown below.

Blue-sensitive emulsion layer:

Anhydro-5,5'-chloro-3,3'-disulfoethylthiacyanine hydroxide

Green-sensitive emulsion layer:

Anhydro-9-ethyl-5,5'-diphenyl-3,3'-disulfoethyloxacarbocyanine hydroxide

Red-sensitive emulsion layer:

3,3'-Diethyl-5-methoxy-9,9'-(2,2'-dimethyl-1,3-propano)thiacarbocyanine iodide

The following compound was used as a stabilizer for each emulsion layer.

A 7:2:1 (mole ratio) mixture of 1-(2-acetamidophenyl)-5-mercaptotetrazole, 1-phenyl-5-mercaptotetrazole and 1-(p-methoxyphenyl)-5-mercaptotetrazole As irradiation inhibitory dyes, the following compounds were used.

[3-Carboxy-5-hydroxy-4-(3-(3-carboxy-5-oxo-1-(2,5-disulfonatophenyl)-2-pyrazolin-4-ylidene)-1-propenyl)-1-pyrazolyl]benzene-2,5-disulfonate disodium salt N,N'-(4,8-Dihydroxy-9,10-dioxo-3,7-disulfonatoanthracene-1,5-diyl)bis(aminomethanesulfonate) tetrasodium salt

[3-Cyano-5-hydroxy-4-(3-(3-cyano-5-oxy-1-(4sulfonatophenyl)2-pyrazolin-4-ylidene)-1-pentanyl)-1pyrazolyl]benzene-4-sulfonate sodium salt Layer Construction The composition of each layer is shown below. The figures represent coating amount (g/m$^2$). The figures for silver halide emulsions represent the coating amounts calculated as silver.

Base sheet

Paper thick laminated with polyethylene thick on both sides

| First layer (blue-sensitive layer) | |
|---|---|
| Silver halide emulsion (AgBr: 0.7 mole %, cubic grain mean particle size 0.9 μm) | 0.28 |
| Gelatin | 1.80 |
| Yellow coupler (ExY) | 0.60 |
| Fading inhibitor (Cpd-1) | 0.28 |
| Solvent (S-74) | 0.01 |
| Solvent (S-75) | 0.03 |

-continued

| | |
|---|---|
| Second layer (color mixing inhibitory layer) | |
| Gelatin | 0.80 |
| Color mixing inhibitor (Cpd-2) | 0.055 |
| Solvent (S-30) | 0.03 |
| Solvent (S-25) | 0.015 |
| Third layer (green-sensitive layer) | |
| Silver halide emulsion (AgBr: 0.7 mole %, cubic grain mean particle size 0.45 μm) | 0.305 |
| Gelatin | 1.40 |
| Magenta coupler (ExM) | 0.67 |
| Fading inhibitor (Cpd-3) | 0.23 |
| Fading inhibitor (Cpd-4) | 0.11 |
| Solvent (S-30) | 0.20 |
| Solvent (S-25) | 0.02 |
| Fourth layer (color mixing inhibiting layer) | |
| Gelatin | 1.70 |
| Color mixing inhibitor (Cpd-2) | 0.065 |
| Ultraviolet absorber (UV-1) | 0.45 |
| Ultraviolet absorber (UV-2) | 0.23 |
| Solvent (S-30) | 0.05 |
| Solvent (S-25) | 0.05 |
| Fifth layer (red-sensitive layer) | |
| Silver halide emulsion (AgBr: 2 mole %, cubic grain mean particle size 0.5 μm) | 0.21 |
| Gelatin | 1.80 |
| Cyan coupler (ExC-1) | 0.26 |
| Cyan coupler (ExC-2) | 0.12 |
| Fading inhibitor (Cpd-1) | 0.20 |
| Additive (Cpd-5) | 0.08 |
| Polymer (P-1) | 0.35 |
| Solvent (S-30) | 0.25 |
| Sixth layer (ultraviolet absorption layer) | |
| Gelatin | 0.70 |
| Ultraviolet absorber (UV-1) | 0.26 |
| Ultraviolet absorber (UV-2) | 0.07 |
| Solvent (S-30) | 0.30 |
| Solvent (S-25) | 0.09 |
| Seventh layer (protective layer) | |
| Gelatin | 1.07 |

The compounds used were as follows:

(Exy) Yellow coupler
α-Pivalyl-α-(3-benzyl-1-hydantoinyl)-2-chloro-5-[β-(dodecylsulfonyl)butyramido]acetoanilide (ExM) Magenta coupler
1-(2,4,6-Trichlorophenyl)3-[2-chloro-5-(3-octadecenylsuccinimido)anilino]-5-pyrazolone (ExC-1) Cyan coupler (C-18)

(ExC-2) Cyan coupler (C-1)

(Cpd-1) Fading inhibitor
2,5-Di-tert-amylphenyl 3,5-di-tert-butylhydroxy-benzoate (Cpd-2) Fading inhibitor
2,5-di-tert-octylhydroquinone (Cpd-3) Fading inhibitor
1,4-Di-tert-amyl-2,5-dioctyloxybenzene (Cpd-4) Fading inhibitor
2,2'-Methylenebis(4-methyl-6-tert-butylphenol)

(Cpd-5) Additive
p-(p-Toluenesulfonamido)phenyldodecane (S-74) Solvent
Described above (S-75) Solvent
Described above (UV-1) Ultraviolet absorber
2-(2-Hydroxy-3,5-di-tert-amylphenyl)benzotriazole (UV-2) Ultraviolet absorber
2-(2-Hydroxy-3,5-di-tert-butylphenyl)benzotriazole (S-30) Solvent
Described above (S-25) Solvent
Described above (P-1) Polymer
Described above Samples Nos. 102 to 107 were prepared in the same manner as the thus-obtained sample No. 101 except that the respective polymer and coupler solvent species specified below in Table 1 were used in the 5th layer emulsion.

TABLE 1

| Sample | Polymers | Coupler solvent species | Remarks |
|---|---|---|---|
| 101 | P-1 | S-30 | Invention |
| 102 | P-17 | S-30 | " |
| 103 | P-25 | S-71 | " |
| 104 | P-26 | S-71 | " |
| 105 | P-53 | S-71 | " |
| 106 | — | S-30 | Comparison |
| 107 | — | S-71 | " |

These coated samples were subjected to the following experiment for evaluating their photographic characteristics.

Each sample was subjected to gradation exposure for sensimetry by means of a sensitometer (Fuji Photo film model FWH semsitometer; light source color temperature 3,200° K.). The exposure time was 1/10 second and the exposure amount was 250 CMS.

The sample was processed by the processing steps mentioned below with the respective processing baths having the compositions specified below on an automatic developing apparatus. The color developer composition was varied as shown in Table 2.

| Process | Temperature | Time |
|---|---|---|
| Color development | 38° C. | 45 sec. |
| Bleach & fix | 30–36° C. | 45 sec. |
| Wash (1) | 30–37° C. | 30 sec. |
| Wash (2) | 30–37° C. | 30 sec. |
| Wash (3) | 30–37° C. | 30 sec. |
| Drying | 70–80° C. | 60 sec. |

The compositions of the respective processing baths are shown below.

| | |
|---|---|
| Color developer | |
| Water | 800 ml |
| Ethylenediamine-N,N,N',N'-tetramethylenephosphonic acid | 3.0 g |
| Diethylenetriaminepentaacetic acid | 1.0 g |
| Organic preservative A (I-1) | 0.03 mol |
| Organic preservative B (I-2) | 0.02 mol |
| Sodium chloride | See Table 2 |
| Potassium bromide | See Table 2 |
| Potassium carbonate | 25 g |
| N-Ethyl-N-(β-methanesulfonamidoethyl)-3-methyl-4-aminoaniline sulfate | 5.0 g |
| Triethanolamine | 10.0 g |
| Fluorescent brightener (4,4'-diaminostilbene compound) | 2.0 g |
| Water to make | 1000 ml |
| pH (25° C.) | 10.05 |
| Bleach-fix bath | |
| Water | 400 ml |
| Ammonium thiosulfate (70%) | 100 ml |
| Ammonium sulfite | 17 g |
| Iron (III) ammonium ethylenediamine-tetraacetate | 55 g |
| Disodium ethylenediamine-tetraacetate | 5 g |
| Ammonium bromide | 40 g |
| Glacial acetic acid | 9 g |
| Water to make | 1000 ml |
| pH (25° C.) | 5.40 |

-continued

| Washing Water |
|---|
| Deionized water (Ca and Mg, not more than 3 ppm each) |

Each processed sample was subjected to sensitometry and the maximum density ($D_{max}$) and minimum density ($D_{min}$) were measured for each of the blue (B), green (G) and red (R) colors using a Macbeth densitometer. The changes in $D_{max}$ and $D_{min}$ caused by the changes in processing bath composition are shown in Table 2.

Separately, the above-mentioned coated samples were each evaluated with respect to sensitization streaks by uniform exposure using a Fuji Photo Film model FWH sensitometer (light source color temperature 3,200° K.) to give a gray color having a reflection density of 0.5. The following four-grade evaluation criteria were used.

| Evaluation with respect to sensitization streaks | Number of sensitization streaks found in 100 $cm^2$ sample surface (10 cm × 10 cm) |
|---|---|
| o | 0 |
| Δ | 1 to 2 |
| x | 3 to 5 |
| xx | 5 or more |

The extent of formation of sensitization streaks resulting from the changes in processing bath composition are shown in Table 2 for the respective samples.

TABLE 2

| | Treatment step | | | | | | | | |
|---|---|---|---|---|---|---|---|---|---|
| | (1) | (2) | (3) | (4) | (5) | (6) | (7) | (8) | (9) |
| Developing solution | | | | | | | | | |
| Chloride ion concentration* | $3.0 \times 10^{-2}$ | $3.0 \times 10^{-2}$ | $3.5 \times 10^{-2}$ | $3.5 \times 10^{-2}$ | $3.5 \times 10^{-2}$ | $3.5 \times 10^{-2}$ | $1.5 \times 10^{-1}$ | $1.5 \times 10^{-1}$ | $2.0 \times 10^{-1}$ |
| Bromide ion concentration* | $1.0 \times 10^{-5}$ | $1.0 \times 10^{-5}$ | $1.0 \times 10^{-5}$ | $1.0 \times 10^{-5}$ | $3.0 \times 10^{-5}$ | $3.0 \times 10^{-5}$ | $1.0 \times 10^{-1}$ | $1.0 \times 10^{-3}$ | $1.0 \times 10^{-3}$ |
| Remarks | Comparison | Comparison | Comparison | Comparison | Invention | Invention | Invention | Invention | Comparison |
| Coated sample | 101 | 106 | 101 | 106 | 101 | 106 | 101 | 106 | 101 |
| Remarks | Invention | Comparison | Invention | Comparison | Invention | Comparison | Invention | Comparison | Invention |
| BL | | | | | | | | | |
| Dmax | 2.40 | 2.39 | 2.40 | 2.40 | 2.41 | 2.41 | 2.40 | 2.40 | 1.92 |
| Dmin | 0.12 | 0.13 | 0.12 | 0.12 | 0.12 | 0.12 | 0.09 | 0.12 | 0.11 |
| GL | | | | | | | | | |
| Dmax | 2.50 | 2.51 | 2.50 | 2.50 | 2.50 | 2.51 | 2.51 | 2.49 | 2.24 |
| Dmin | 0.12 | 0.13 | 0.12 | 0.13 | 0.09 | 0.13 | 0.09 | 0.12 | 0.12 |
| RL | | | | | | | | | |
| Dmax | 2.98 | 2.99 | 2.98 | 2.98 | 2.98 | 2.97 | 2.90 | 2.98 | 2.72 |
| Dmin | 0.13 | 0.14 | 0.12 | 0.13 | 0.09 | 0.13 | 0.10 | 0.12 | 0.12 |
| Sensitization streaks | xx | xx | x | xx | o | x | o | x | Δ |
| Remarks (treatment-coated) sample combination) | Comparison | Comparison | Comparison | Comparison | Invention | Comparison | Invention | Comparison | Comparison |

| | Treatment step | | | | | | | |
|---|---|---|---|---|---|---|---|---|
| | (10) | (11) | (12) | (13) | (14) | (15) | (16) | (17) |
| Developing solution | | | | | | | | |
| Chloride ion concentration* | $2.0 \times 10^{-1}$ | $2.0 \times 10^{-1}$ | $2.0 \times 10^{-1}$ | $1.0 \times 10^{-1}$ | $1.0 \times 10^{-1}$ | $1.0 \times 10^{-1}$ | $1.0 \times 10^{-1}$ | $1.0 \times 10^{-1}$ |
| Bromide ion concentration* | $1.0 \times 10^{-3}$ | $1.5 \times 10^{-3}$ | $1.5 \times 10^{-3}$ | $5.0 \times 10^{-4}$ | $5.0 \times 10^{-4}$ | $5.0 \times 10^{-4}$ | $5.0 \times 10^{-4}$ | $5.0 \times 10^{-4}$ |
| Remarks | Comparison | Comparison | Invention | Invention | Invention | Invention | Invention | Invention |
| Coated sample | 106 | 101 | 106 | 102 | 103 | 104 | 105 | 107 |
| Remarks | Comparison | Invention | Comparison | Invention | Comparison | Invention | Invention | Comparison |
| BL | | | | | | | | |
| Dmax | 1.93 | 1.92 | 1.91 | 2.41 | 2.40 | 2.40 | 2.39 | 2.39 |
| Dmin | 0.11 | 0.12 | 0.12 | 0.10 | 0.09 | 0.09 | 0.09 | 0.12 |
| GL | | | | | | | | |
| Dmax | 2.23 | 2.23 | 2.24 | 2.51 | 2.50 | 2.50 | 2.51 | 2.50 |
| Dmin | 0.12 | 0.12 | 0.12 | 0.09 | 1.10 | 0.09 | 0.09 | 0.12 |
| RL | | | | | | | | |
| Dmax | 2.71 | 2.71 | 2.71 | 2.98 | 2.98 | 2.98 | 2.99 | 2.98 |
| Dmin | 0.12 | 0.12 | 0.12 | 0.09 | 0.09 | 0.10 | 0.09 | 0.12 |
| Sensitization streaks | xx | x | xx | o | o | o | o | x |
| Remarks (treatment-coated) sample combination) | Comparison | Comparison | Comparison | Invention | Invention | Invention | Invention | Comparison |

*The bromide ion and chloride ion concentrations are given in terms of mol/liter.

The data shown in Table 2 indicate that when the halogen contents of the developer were either insufficient or excessive as compared with the ranges specified in accordance with the invention, either the minimum density was undesirably high or the maximum density was unsatisfactorily low, with occurrence of sensitization streaks (runs 1, 2, 3, 4, 9, 10, 11 and 12). When the developer had a halogen composition falling within the scope of the invention and only when the photosensitive material was one according to the invention, the minimum density was low and the formation of sensitization streaks was prevented (runs 5 and 7). It is also apparent that a low minimum density and inhibition of sensitization streak formation were attained when different polymer species were used in the photosensitive material within the scope of the invention (runs 13, 14, 15, 16 and 17).

EXAMPLE 2

Using a paper base laminated with polyethylene on both sides, the following multi-layer color printing paper 201 was prepared. The coating compositions were prepared in the following manner.

First layer coating solution

To a mixture of 19.1 g of yellow coupler ExY, 4.4 g of color image stabilizer Cpd-1 and 0.7 g of color image stabilizer Cpd-7 were added 272.2 cc of ethyl acetate and 8.2 g of solvent S-9 and the resulting solution was dispersed and emulsified in 185 cc of a 10% aqueous gelatin solution containing 8 cc of 10% sodium dodecylbenzenesulfonate. Separately, to a silver chlorobromide emulsion (average cubic grain size 0.88 μm, grain size distribution variation factor 0.08, grain surface silver bromide content 0.2% mole) were added $2.0\times10^{-4}$ moles each of the blue-sensitive sensitizing dyes described below per mole of Ag and the mixture was subjected to sulfur sensitization. This emulsion was mixed with the above emulsified dispersion to give a first layer coating solution as described below. The second layer to 7th layer coating solutions were also prepared in a similar manner. As the gelatin hardener for each layer, 1-oxy3,5-dichloro-s-triazine sodium salt was used.

The spectral sensitizing dyes used in the respective layers are shown below.

Blue-sensitive emulsion layer

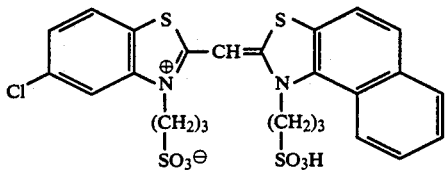

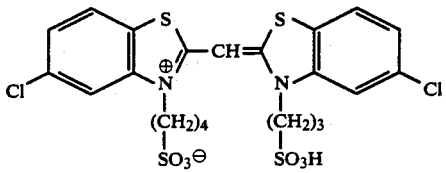

($2.0\times10^{-4}$ moles each per mole of silver halide)

Green-sensitive emulsion layer

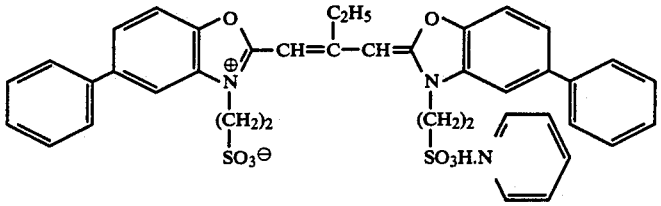

($4.0\times10^{-4}$ moles per mole of silver halide)

and

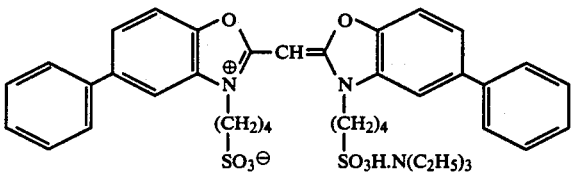

($7.0\times10^{-5}$ moles per mole of silver halide)

Red-sensitive emulsion layer

-continued

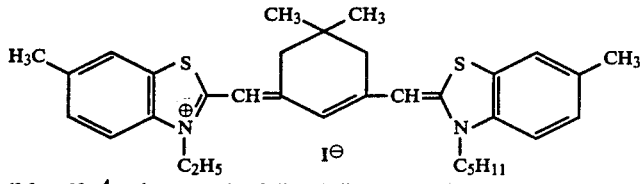

(0.9 × $10^{-4}$ moles per mole of silver halide)

To the red-sensitive emulsion layer, the following compound was added in a proportion of $2.6\times10^{-3}$ mols per mole of silver halide.

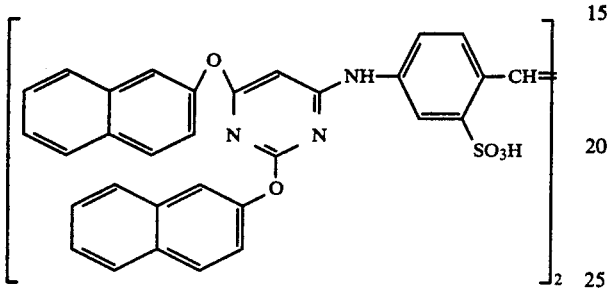

To the blue-, green- and red-sensitive emulsion layers, 1-(5-methylureidophenyl)-5-mercaptotetrazole was added in proportions of $8.5\times10^{-5}$ moles, $7.7\times10^{-4}$ moles and $2.5\times10^{-4}$ moles, respectively.

For prevention of irradiation, the following dyes were added to each of the emulsion layers.

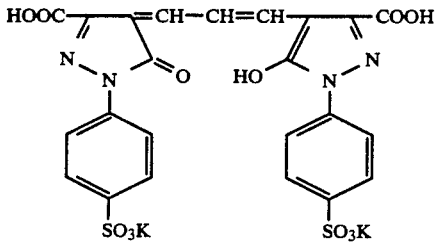

and

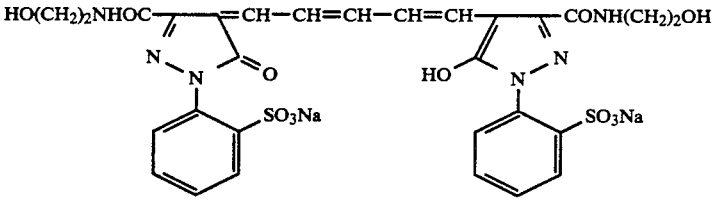

Layer construction

The composition of each layer is shown below. The figures represent coating amounts (g/m²). The figures for silver halide emulsions represent the coating amounts calculated as silver.

Base sheet

Polyethylene laminated paper [containing a white pigment ($TiO_2$) and a blue dye (ultramarine) in the polyethylene film on the first layer side]

| First layer (blue-sensitive layer) | |
|---|---|
| Silver chlorobromide emulsion | 0.30 |
| Gelatin | 1.86 |
| Yellow coupler (ExY) | 0.82 |
| Color image stabilizer | 1.19 |
| Solvent (S-9) | 0.35 |
| Color image stabilizer (Cpd-7) | 0.06 |
| Second layer (Color mixing inhibition layer) | |
| Gelatin | 0.99 |
| Color mixing inhibitor (Cpd-5) | 0.08 |
| Solvent (S-25) | 0.16 |
| Solvent (S-16) | 0.08 |
| Third layer (Green-sensitive layer) | |
| Silver chlorobromide emulsion [a 1:3 (moles of Ag) mixture of grains with an average cubic grain size of 0.55 μm and 0.39 μm; grain size distribution variation factors: 0.10 and 0.08, respectively; grain surface AgBr content 0.8 mole %] | 0.12 |
| Gelatin | 1.24 |
| Magenta coupler (ExM) | 0.27 |
| Color image stabilizer (Cpd-3) | 0.15 |
| Color image stabilizer (Cpd-8) | 0.02 |
| Color image stabilizer (Cpd-7) | 0.03 |
| Solvent (S-7) | 0.36 |
| Solvent (S-16) | 0.18 |
| Fourth layer (Ultraviolet absorption layer) | |
| Gelatin | 1.58 |
| Ultraviolet absorber (UV-1) | 0.47 |
| Color mixing inhibitor (Cpd-5) | 0.05 |
| Solvent (S-69) | 0.24 |
| Fifth layer (Red-sensitive layer) | |
| Silver chlorobromide emulsion [a 1:4 (moles of Ag) mixture of grains with an average cubic grain size of 0.58 μm and 0.45 μm; grain size distribution variation factors: 0.09 and 0.11, respectively; grain surface AgBr content 0.6 mole %] | 0.23 |
| Gelatin | 1.34 |
| Cyan coupler (ExC) | 0.32 |
| Color image stabilizer (Cpd-6) | 0.17 |
| Color image stabilizer (Cpd-2) | 0.04 |
| Solvent (S-71) | 0.15 |

-continued

| | |
|---|---|
| Polymer (P-17) | 0.40 |
| Sixth layer (Ultraviolet absorption layer) | |
| Gelatin | 0.53 |
| Ultraviolet absorber (UV-1) | 0.16 |
| Color mixing inhibitor (Cpd-5) | 0.02 |
| Solvent (S-71) | 0.08 |

-continued

| | |
|---|---|
| Seventh layer (Protective layer) | |
| Gelatin | 1.33 |
| Acryl-modified polyvinyl alcohol (degree of modification 17 mole %) | 0.17 |
| Liquid paraffin | 0.03 |

The compounds used were as follows.

(ExY) Yellow coupler

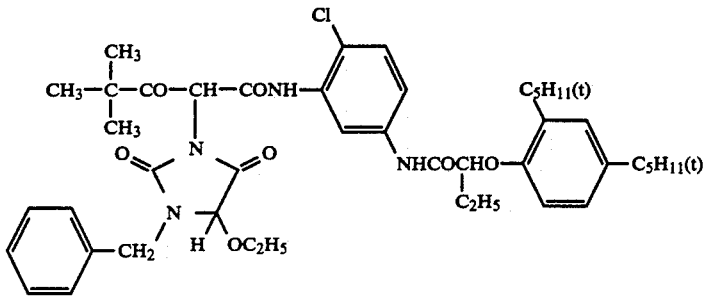

(ExM) Magenta coupler

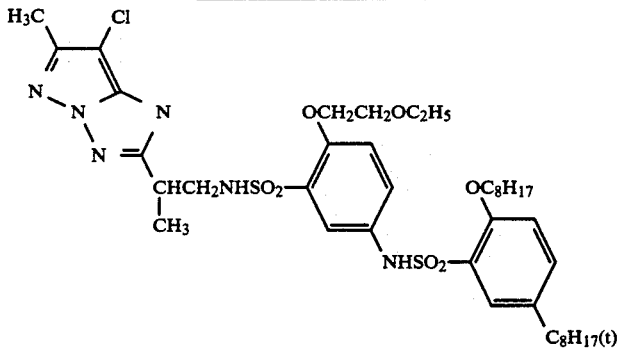

(ExC) Cyan coupler

A 2:4:4 (by weight mixture of C-1, C-47 and C-11.

(Cpd-1) Color image stabilizer

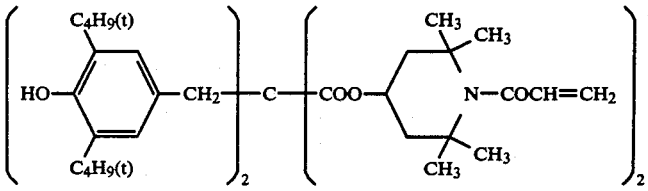

(Cpd-2) Color image stabilizer

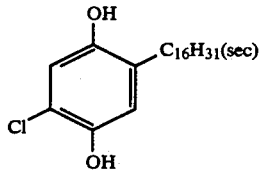

(Cpd-3) Color image stabilizer

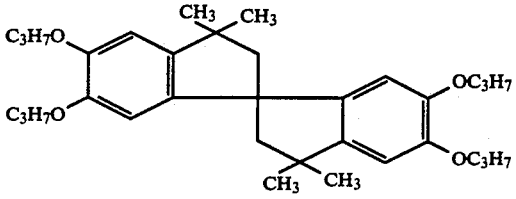

(Cpd-4) Color image stabilizer

-continued
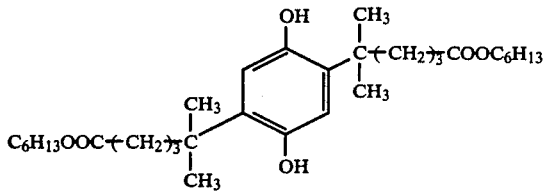
(Cpd-5) Color mixing inhibitor
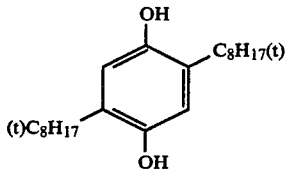
(Cpd-6) Color image stabilizer
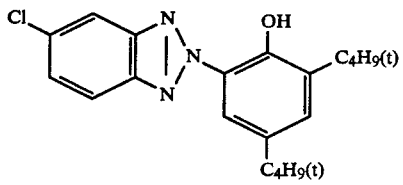
(A)
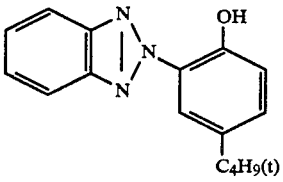
(B)
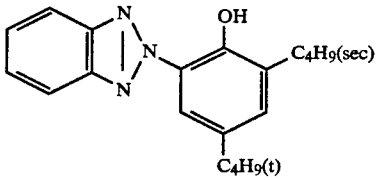
(C)
A 2:4:4 (by weight) mixture of the above compounds (A):(B):(C).
(Cpd-7) Color image stabilizer
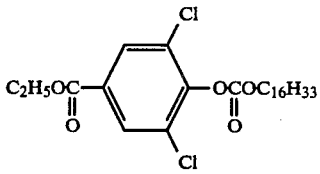
(Cpd-8) Color image stabilizer
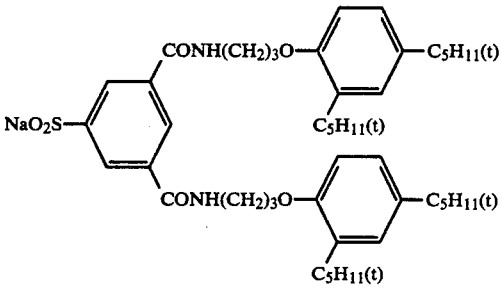
(UV-1) Ultraviolet absorber -continued

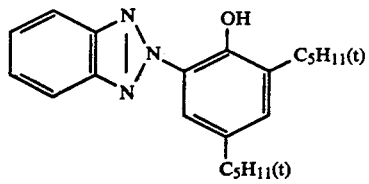

(D)

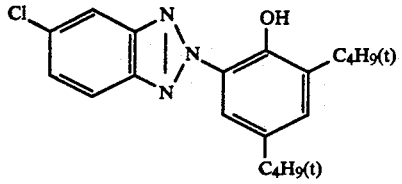

(E)

and

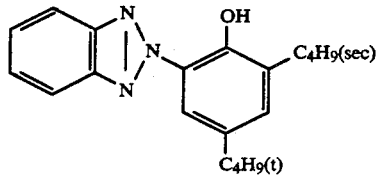

(F)

A 4:2:4 (by weight) mixture of the above compounds (D):(E):(F).

Samples Nos. 202 to 213 were prepared in the same manner as the thus-obtained sample No. 201 except that the respective polymer and coupler species identified below in Table 3 were used.

TABLE 3

| Sample | Polymer | Coupler solvent | Remarks |
|---|---|---|---|
| 201 | P-17 | S-71 | Invention |
| 202 | P-66 | S-71 | " |
| 203 | P-69 | S-71 | " |
| 204 | P-26 | S-71 | " |
| 205 | P-17 | S-39/S-9 (1:1 (by weight) mixture) | " |
| 206 | P-25 | S-39/S-9 " | " |
| 207 | P-53 | S-39/S-9 " | " |
| 208 | P-67 | S-71/S-72 " | " |
| 209 | P-66 | S-71/S-72 " | " |
| 210 | P-1 | S-73/S-5 " | " |
| 211 | P-57 | S-73/S-5 " | " |
| 212 | — | S-71 | Comparison |
| 213 | — | S-39/S-9 (1:1 (by weight) mixture) | " |

The above samples Nos. 201 to 213 were subjected to exposure in the same manner as mentioned above and then to continuous processing (running test) in the steps specified below using a paper processing apparatus until the color developer replenishment amounted to a volume twice the tank capacity.

| Process | Temperature | Time | Replenishment* | Tank capacity |
|---|---|---|---|---|
| Color development | 38° C. | 45 sec. | 73 ml | 4 l |
| Bleach & fix | 30–36° C. | 45 sec. | 215 ml | 4 l |

-continued

| Process | Temperature | Time | Replenishment* | Tank capacity |
|---|---|---|---|---|
| Wash (1) | 30–37° C. | 0 sec. | — | 2 l |
| Wash (2) | 30–37° C. | 0 sec. | — | 2 l |
| Wash (3) | 30–37° C. | 0 sec. | 250 ml | 2 l |
| Drying | 70–85° C. | 60 sec. | | |

*The volume per $m^2$ of the photosensitive material
Three-tank counter-current system (3) → (1)

The compositions of the respective processing baths are shown below.

| Color developer | Bath | Replenisher |
|---|---|---|
| Water | 800 ml | 800 ml |
| Ethylenediamine-N,N,N',N'-tetramethylenephosphonic acid | 5.0 g | 5.0 g |
| Triethanolamine | 8.0 g | 8.0 g |
| Sodium chloride | See Table 5 | See Table 5 |
| Potassium bromide | See Table 5 | See Table 5 |
| Potassium carbonate | 25 g | 25 g |
| N-Ethyl-N-(β-methanesulfonamidoethyl)-3-methyl-4-aminoaniline sulfate | 5.0 g | 15.0 g |
| Organic preservative (II-19) | 0.03 mol | 0.03 mol |
| Sodium sulfite | 0.02 g | 0.02 g |
| Fluorescent brightener (Whitex 4, Sumitomo Chemical; diaminostilbene compound) | 1.0 g | 3.0 g |
| Water to make | 1000 ml | 1000 ml |
| pH (25° C.) | 10.05 | 10.65 |
| Bleach-fix bath (same for bath and replenisher) | | |
| Water | 400 ml | |
| Ammonium thiosulfate (70%) | 100 ml | |
| Ammonium sulfite | 17 g | |
| Iron (III) ammonium ethylenediaminetetraacetate | 55 g | |
| Disodium ethylenediaminetetraacetate | 5 g | |
| Ammonium bromide | 30 g | |
| Glacial acetic acid | 9 g | |
| Water to make | 1000 ml | |

-continued

| Color developer | Bath | Replenisher |
|---|---|---|
| pH (25° C.) | 5.40 | |

As washing (rinse) water, deionized water with Ca and Mg contents not more than 3 ppm each was used.

The chloride ion concentration and bromide ion concentration in the developer initially fed to the tank in the replenishment were selected so that the chloride and bromide concentrations in the liquid phase in the tank could be maintained throughout the running processing from start to finish.

The above coated samples were given gradation exposure for sensitometry using a sensitometer (Fuji Photo Film model FWH; light source color temperature 3,200° K). The exposure time was 1/10 second and the exposure amount was 250 CMS.

The photosensitive material samples processed at the start and the end of the running test were subjected to densitometry using a Macbeth densitometer. The maximum and (R) density ($D_{max}$) and minimum red density ($D_{min}$) at the start of running and the change in minimum red density as resulting from the continuous processing ($\Delta D_{min}=D_{min}$ at the end of running$-D_{min}$ at the start of running) were thus determined. The results are shown in Table 4.

Separately, the above coated sample were subjected to uniform exposure to give a gray color having a reflection density of 0.5 and those obtained at the end of running were evaluated with respect to sensitization streaks in the same manner as in Example 1. The results obtained are shown also in Table 4.

TABLE 4

| | Treatment step | | | | | | | | |
|---|---|---|---|---|---|---|---|---|---|
| | (1) | (2) | (3) | (4) | (5) | (6) | (7) | (8) | (9) |
| Developing solution | | | | | | | | | |
| Chloride ion concentration* | $3.0 \times 10^{-2}$ | $3.0 \times 10^{-2}$ | $4.0 \times 10^{-2}$ | $4.0 \times 10^{-2}$ | $2.0 \times 10^{-1}$ | $2.0 \times 10^{-1}$ | $4.0 \times 10^{-2}$ | $4.0 \times 10^{-2}$ | $4.0 \times 10^{-2}$ |
| Bromide ion concentration* | $1.0 \times 10^{-5}$ | $1.0 \times 10^{-5}$ | $5.0 \times 10^{-5}$ | $5.0 \times 10^{-5}$ | $1.0 \times 10^{-35}$ | $1.0 \times 10^{-3}$ | $5.0 \times 10^{-5}$ | $5.0 \times 10^{-5}$ | $5.0 \times 10^{-5}$ |
| Remarks | Comparison | Comparison | Invention | Invention | Comparison | Comparison | Invention | Invention | Invention |
| Coated sample | 201 | 212 | 201 | 212 | 201 | 212 | 201 | 203 | 204 |
| Remarks | Invention | Comparison | Invention | Comparison | Invention | Comparison | Invention | Invention | Invention |
| BL | | | | | | | | | |
| Dmax | 2.98 | 2.98 | 2.99 | 2.98 | 2.70 | 2.71 | 2.98 | 2.99 | 2.98 |
| Dmin | 0.13 | 0.13 | 0.09 | 0.12 | 0.11 | 0.11 | 0.09 | 0.09 | 0.09 |
| ΔDmin | 0.02 | 0.01 | 0.01 | 0.02 | 0.03 | 0.03 | 0.01 | 0.01 | 0.01 |
| Sensitization streaks | xx | xx | o | x | Δ | x | o | o | o |
| Remarks (treatment-coated) sample combination) | Comparison | Comparison | Invention | Comparison | Comparison | Comparison | Invention | Invention | Invention |

| | Treatment step | | | | | | | |
|---|---|---|---|---|---|---|---|---|
| | (10) | (11) | (12) | (13) | (14) | (15) | (16) | (17) |
| Developing solution | | | | | | | | |
| Chloride ion concentration* | $4.0 \times 10^{-2}$ | $4.0 \times 10^{-2}$ | $4.0 \times 10^{-2}$ | $4.0 \times 10^{-2}$ | $4.0 \times 10^{-2}$ | $4.0 \times 10^{-2}$ | $4.0 \times 10^{-2}$ | $4.0 \times 10^{-2}$ |
| Bromide ion concentration* | $5.0 \times 10^{-5}$ | $5.0 \times 10^{-5}$ | $5.0 \times 10^{-5}$ | $5.0 \times 10^{-5}$ | $5.0 \times 10^{-5}$ | $5.0 \times 10^{-5}$ | $5.0 \times 10^{-5}$ | $5.0 \times 10^{-5}$ |
| Remarks | Invention | Invention | Invention | Invention | Invention | Invention | Invention | Invention |
| Coated sample | 205 | 206 | 207 | 208 | 209 | 210 | 211 | 213 |
| Remarks | Invention | Invention | Invention | Invention | Invention | Invention | Invention | Comparison |
| BL | | | | | | | | |
| Dmax | 2.98 | 2.98 | 2.98 | 2.98 | 2.98 | 2.99 | 2.98 | 2.98 |
| Dmin | 0.10 | 0.09 | 0.10 | 0.09 | 0.09 | 0.09 | 0.09 | 0.12 |
| ΔDmin | −0.01 | 0.00 | 0.01 | 0.01 | 0.00 | −0.01 | 0.01 | 0.02 |
| Sensitization streaks | o | o | o | o | o | o | o | x |
| Remarks (treatment-coated) sample combination) | Invention | Invention | Invention | Invention | Invention | Invention | Invention | Comparison |

*The bromide ion and chloride ion concentrations are given in terms of mol/liter.

The data shown in Table 4 indicate that when the developers used were outside the scope of the invention, the minimum density was high or, even if the minimum density was low, the change in minimum density was great between the start and finish of continuous processing; the maximum density was too low, and/or sensitization streaks were formed (runs 1, 2, 5 and 6). In cases where the developers according to the invention were used for processing, the change in minimum density and the formation of sensitization streaks was suppressed only when the photosensitive materials according to the invention were used (runs 3 and 4). It is also apparent that the objects of the invention were accomplished using various polymer and coupler solvent species in the photosensitive material according to the invention (runs 7 to 16).

EXAMPLE 3

Samples Nos. 301 to 307 were prepared in the same manner as the sample 201 of Example 2 except that the cyan coupler species used in sample 201 was replaced with an equimolar amount of each coupler specified below in Table 5.

TABLE 5

| Sample | Cyan coupler species |
|---|---|
| 301 | 3-1 |
| 302 | C-2 |
| 303 | C-3 |
| 304 | C-11 |
| 305 | C-14 |
| 306 | C-18 |
| 307 | C-25 |

Samples Nos. 301 to 307 were tested in the same manner as in Example 2. As a result, it was found that, in accordance with the invention, a low minimum density was obtained and the generation of sensitization streaks was inhibited with these different cyan couplers.

EXAMPLE 4

Samples Nos. 401 to 406 were prepared in the same manner as the sample No. 201 of Example 2 except that the total silver coating amount was varied as shown in Table 6 by increasing or decreasing the silver contents of the respective layers at the same rate.

TABLE 6

| Sample | Cyan coupler species ($g/m^2$) |
|---|---|
| 401 | 0.20 |
| 402 | 0.30 |
| 403 | 0.50 |
| 404 | 0.75 |
| 405 | 0.80 |
| 406 | 1.00 |

The samples Nos. 401 to 406 were evaluated for minimum density and sensitization streak formation in the same manner as in Example 2. The results obtained are shown in Table 7. The same developer solution as used in Example 2 was used except that the chloride ion and bromide ion concentrations were varied as shown in Table 7.

TABLE 7

| | Treatment step | | | | | | | | |
|---|---|---|---|---|---|---|---|---|---|
| | (1) | (2) | (3) | (4) | (5) | (6) | (7) | (8) | (9) |
| Developing solution | | | | | | | | | |
| Chloride ion concentration* (mol/l) | $1.0 \times 10^{-1}$ | $1.0 \times 10^{-1}$ | $1.0 \times 10^{-1}$ | $1.0 \times 10^{-1}$ | $1.0 \times 10^{-1}$ | $1.0 \times 10^{-1}$ | $3.0 \times 10^{-3}$ | $3.0 \times 10^{-3}$ | $3.0 \times 10^{-3}$ |
| Bromide ion concentration* (mol/l) | $5.0 \times 10^{-4}$ | $5.0 \times 10^{-4}$ | $5.0 \times 10^{-4}$ | $5.0 \times 10^{-4}$ | $5.0 \times 10^{-4}$ | $5.0 \times 10^{-4}$ | $2.0 \times 10^{-5}$ | $2.0 \times 10^{-5}$ | $2.0 \times 10^{-5}$ |
| Coated sample | 401 | 402 | 403 | 404 | 405 | 406 | 403 | 404 | 405 |
| RL Dmax | 0.07 | 0.08 | 0.09 | 0.11 | 0.12 | 0.16 | 0.15 | 0.16 | 0.16 |
| Sensitization streaks | Δ | o | o | o | o | Δ | x | xx | xx |
| Remarks | Invention | Invention | Invention | Invention | Invention | Invention | Comparison | Comparison | Comparison |

*The bromide ion and chloride ion concentrations are given in terms of mol/liter.

The data shown in Table 7 indicate that the formation of sensitization streaks was suppressed when the photosensitive material according to the invention is processed with the developer according to the invention. In particular, it is apparent that samples having a silver coating amount of 0.30 to 0.80 $g/m^2$ had a low minimum density, with the generation of sensitization streaks being inhibited.

As described in detail hereinabove, the invention provides a method for rapid processing providing a high maximum density and a low minimum density, with various types of pressure sensitization fogging being prevented and with variations in photographic characteristics resulting from continuous processing being minimized.

While the invention has been described in detail and with reference to specific examples thereof, it will be apparent to one skilled in the art that various changes and modifications can be made therein without departing from the spirit and scope thereof.

What is claimed is:

1. A method for processing a silver halide color photosensitive material which comprises developing an image-wise exposed color photographic light-sensitive material comprising a support having thereon at least one light-sensitive silver halide emulsion layer containing a silver halide comprising at least 80 mol % silver chloride; at least one emulsion layer thereof comprising a dispersion of a mixture of (i) at least one oil-soluble non-diffusible cyan coupler capable of forming a substantially non-diffusible cyan dye by coupling with the oxidized form of a developing agent, and (ii) a water-insoluble polymer;

in a color developer solution comprising a primary amine color developing agent, and having a chloride ion concentration of from $3.5\times10^{-2}$ to $1.5\times10^{-1}$ mol/l, and a bromide ion concentration of from $3.0\times10^{-5}$ to $1.0\times10^{-3}$ mol/l.

2. The method as claimed in claim 1, wherein said developer solution comprises from 0.005 to 0.5 mol/l of an organic preservative represented by formulae (I) or (II):

$$R^{11}-\underset{\underset{OH}{|}}{N}-R^{12} \qquad (I)$$

wherein $R^{11}$ and $R^{12}$ each represents a hydrogen atom, an unsubstituted or substituted alkyl group, an unsubstituted or substituted alkenyl group, an unsubstituted or substituted aryl group or a substituted or unsubstituted heteroaromatic group, provided that at least one of $R^{11}$ and $R^{12}$ is a group other than a hydrogen atom, and $R^{11}$ and $R^{12}$ may be linked to form a saturated or unsaturated 5-membered or 6-membered heterocyclic ring; and

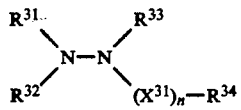

(II)

wherein $R^{31}$, $R^{32}$ and $R^{33}$ each represents a hydrogen atom, a substituted or unsubstituted alkyl group, a substituted or unsubstituted aryl group, or a substituted or unsubstituted heterocyclic group; $R^{34}$ represents a hydroxyl group, a hydroxyamino group, a substituted or unsubstituted akyl group, a substituted or unsubstituted aryl group, a substituted or unsubstituted heterocyclic group, a substituted or unsubstituted alkoxy group, a substituted or unsubstituted aryloxy group, a substituted or unsubstituted carbamoyl group or a substituted or unsubstituted amino group; $X^{31}$ represents —CO—, —$SO_2$— or —C(=NH)—; and n is 0 or 1; provided that when n is 0, $R^{34}$ represents an alkyl group, an aryl group or a heterocyclic group; and $R^{33}$ and $R^{34}$ may be linked to form a heterocyclic ring.

3. The method as claimed in claim 2, wherein $R^{11}$ and $R^{12}$ each represents a substituted or unsubstituted alkyl group containing 1 to 10 carbon atoms or a substituted or unsubstituted alkenyl group containing 2 to 10 carbon atoms, each said substituted group being substituted with a substituent selected from the group consisting of a hydroxyl group, an alkoxy group, an alkylsulfonyl group, an arylsulfonyl group, an amido group, a carboxyl group, a cyano group, a sulfo group, a nitro group and an amino group.

4. The method as claimed in claim 3, wherein said alkyl group and alkenyl group represented by $R^{11}$ and $R^{12}$ each contains 1 to 5 Carbon atoms.

5. The method as claimed in claim 2, wherein each of $R^{31}$, $R^{32}$ and $R^{33}$ each represents a hydrogen atom or a substituted or unsubstituted alkyl group containing 1 to 10 carbon atoms; $R^{34}$ represents a substituted or unsubstituted alkyl group, a substituted or unsubstituted aryl group, a substituted or unsubstituted alkoxy group, a substituted or unsubstituted carbamoyl group, or a substituted or unsubstituted amino group; each said substituted group being substituted with at least one substituent selected from the group consisting of a carboxyl group, a sulfo group, a nitro group, an amino group and a phosphono group; and $X^{31}$ represents —CO— or —$SO_2$—.

6. The method as claimed in claim 5, wherein $R^{31}$ and $R^{32}$ each a represents hydrogen; atom $R^{34}$ represents a substituted or unsubstituted alkyl group; and $X^{31}$ represents —CO—.

7. The method as claimed in claim 2, wherein said developer solution further comprises at least one compound represented by formulae (III) or (IV):

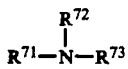

(III)

wherein $R^{71}$, $R^{72}$ and $R^{73}$ each represents hydrogen, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; provided that $R^{71}$ and $R^{72}$, and $R^{71}$ and $R^{73}$, or $R^{72}$ and $R^{73}$ may be linked to form a heterocyclic ring; and

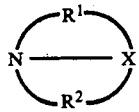

(IV)

wherein X represents a trivalent atom or atomic group necessary for forming a condensed ring; and $R^1$ and $R^2$ each represents a substituted or unsubstituted alkylene group, a substituted or unsubstituted alkenylene group, or a substituted or unsubstituted aralkylene group.

8. The method as claimed in claim 1, wherein said color developer solution contains not more than 2.0 ml/l of benzyl alcohol.

9. The method as claimed in claim 1, wherein said water-insoluble polymer is organic solvent-soluble, and has a molecular weight of at most 150,000, which is a vinyl polymer or a polyester polymer.

10. The method as claimed in claim 1, wherein said cyan coupler is represented by formula (Va) or (Vb):

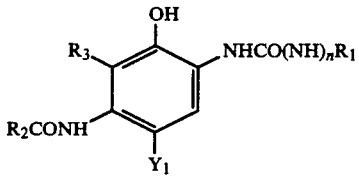

(Va)

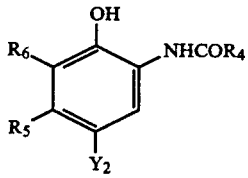

(Vb)

wherein $R_1$, $R_2$ and $R_4$ each represents a substituted or unsubstituted aliphatic group, a substituted or unsubstituted aromatic group or a substituted or unsubstituted heterocyclic group; $R_3$, $R_5$ and $R_6$ each represents a hydrogen atom, a halogen atom, a substituted or unsubstituted aliphatic group, a substituted or unsubstituted aromatic group or a substituted or unsubstituted acylamino group; provided that $R_3$ may be linked with $R_2$ to form a 5-membered or 6-membered heterocyclic ring; $Y_1$ and $R_2$ each represents a hydrogen atom or a coupling-off group; and n is 0 or 1.

11. The method as claimed in claim 10, wherein $R_1$ represents an aryl group or a heterocyclic group; $R_2$ represents a substituted or unsubstituted alkyl group or a substituted or unsubstituted aryl group; $R_3$ represents a hydrogen atom; $R_4$ represents a substituted or unsubstituted alkyl group or a substituted or unsubstituted aryl group; $R_5$ represents an alkyl group containing 1 to 15 carbon atoms or a substituted methyl group substituted with a substituent selected from the group consisting of an arylthio group, an alkylthio group, an acylamino group, an aryloxy group and an alkyloxy group; $R_6$ represents a hydrogen atom or a halogen atom; and $Y_1$ and $Y_2$ each represents a hydrogen atom, a halogen atom, an alkoxy group, an aryloxy group, an acyloxy group, or a sulfonamido group.

12. The method as claimed in claim 11, wherein $R_1$ represents an aryl group substituted with a substituent selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, and a cyano group; $R_2$ represents a substituted aryloxy-substituted alkyl group; $R_4$ represents a substituted aryloxy-substituted alkyl group; $R_5$ represents an alkyl group containing 2 to 4 carbon atoms; $R_6$ represents chlorine or fluorine; $Y_2$ represents chlorine or fluorine; and when n is 0, $Y_1$ represents chlorine or fluorine.

13. The method as claimed in claim 1, wherein said silver halide in said light-sensitive silver halide emulsion layer contains at least 95 mol % silver chloride.

14. The method as claimed in claim 13, wherein said silver halide contains at least 98 mol % silver chloride.

15. The method as claimed in claim 14, wherein said light-sensitive silver halide emulsion layer contains at most 0.8 $g/m^2$ of silver contained in said silver halide.

16. The method as claimed in claim 1, wherein said color developer has a chloride ion concentration of $4\times10^{-2}$ to $1\times10^{-1}$ mol/l.

17. The method as claimed in claim 1, wherein said color developer has a bromide ion concentration of from $5.0\times10^{-5}$ to $5\times10^{-4}$ mol/l.

18. The method as claimed in claim 1, wherein said dispersion additionally comprises an auxiliary solvent and the weight ratio of said polymer to said auxiliary solvent is about 1:1 to about 1:50.

19. The method as claimed in claim 1, wherein the weight ratio of said polymer to said cyan coupler is from 1:20 to 20:1.

20. The method as claimed in claim 9, wherein said vinyl polymer or polyester polymer has a bonding group of the formula $$-\overset{\overset{\displaystyle O}{\|}}{C}-$$

21. The method as claimed in claim 9, wherein said vinyl polymer or polyester is a methacrylate polymer, an acrylamide polymer, or a methacrylamide polymer.

22. The method as claimed in claim 20, wherein said vinyl polymer or polyester is an acrylamide polymer or a methacrylamide polymer.

23. The method as claimed in claim 13, wherein said light-sensitive silver halide emulsion layer contains silver in an amount of 0.3 to 0.75 $g/m^2$.

24. The method as claimed in claim 8, wherein said color developer solution contains no benzyl alcohol.

25. The method as claimed in claim 1, wherein said color developer solution contains substantially no sulfite ion.

* * * * *